US011583073B2

(12) United States Patent
Parab et al.

(10) Patent No.: US 11,583,073 B2
(45) Date of Patent: Feb. 21, 2023

(54) SHELF SUPPORT BEAMS AND SHELVING UNITS UTILIZING SAME

(71) Applicant: Edsal Manufacturing Company, Inc., Chicago, IL (US)

(72) Inventors: Rohan Parab, Chicago, IL (US); Jeff Lamber, Minooka, IL (US); Anthony J. Troyner, Shorewood, IL (US); Mitchell Liss, Northbrook, IL (US); Mitchell E. Bianchin, Villa Park, IL (US)

(73) Assignee: Edsal Manufacturing Company, Inc., Chicago, IL (US)

( * ) Notice: Subject to any disclaimer, the term of this patent is extended or adjusted under 35 U.S.C. 154(b) by 0 days.

(21) Appl. No.: 17/264,376

(22) PCT Filed: Apr. 22, 2020

(86) PCT No.: PCT/US2020/029236
§ 371 (c)(1),
(2) Date: Jan. 29, 2021

(87) PCT Pub. No.: WO2020/219500
PCT Pub. Date: Oct. 29, 2020

(65) Prior Publication Data

US 2022/0031066 A1 Feb. 3, 2022

Related U.S. Application Data

(60) Provisional application No. 62/837,221, filed on Apr. 23, 2019.

(51) Int. Cl.
*A47B 47/00* (2006.01)
*A47B 47/02* (2006.01)
(Continued)

(52) U.S. Cl.
CPC ..... *A47B 47/0083* (2013.01); *A47B 47/027* (2013.01); *A47B 47/028* (2013.01);
(Continued)

(58) Field of Classification Search
CPC ..... A47B 47/083; A47B 47/027; A47B 47/028; A47B 96/021; A47B 96/1441
See application file for complete search history.

(56) References Cited

U.S. PATENT DOCUMENTS 3,194,408 A * 7/1965 Kimpton ..... A47B 57/402 211/183
3,278,043 A 10/1966 Kimpton
(Continued)

FOREIGN PATENT DOCUMENTS

GB 952576 3/1964

OTHER PUBLICATIONS

European Patent Office, International Search Report and Written Opinion in PCT Application No. PCT/US2020/029236, dated Jun. 9, 2020.

(Continued)

*Primary Examiner* — Kimberley S Wright
(74) *Attorney, Agent, or Firm* — Wood Herron & Evans LLP

(57) ABSTRACT

A shelf support beam (80, 130, 200) for use in a shelving unit (10) to support a shelf (22). A structural member (82, 132, 202) has a C-shaped cross-section. A web (94, 144, 216) separates a top flange (96, 146, 220) from a bottom flange (112, 162, 234). The top flange (96, 146, 220) is configured to support the shelf (22). The web (94, 144, 216), the top flange (96, 146, 220), and the bottom flange (112, 162, 234) define a channel (92, 142, 214) of the member (82, 132, 202). The channel (92, 142, 214) defines a cavity height (C1, D1, E1). The top flange (96, 146, 220) and the bottom flange
(Continued)

(112, 162, 234) define a top flange width (C2, D2, E2) and a bottom flange width (C3, D3, E3), respectively. A ratio of the cavity height (C1, D1, E1) to a sum of the top flange width (C2, D2, E2) and the bottom flange width (C3, D3, E3) is greater than 1, is at least 1.20, or is about 1.40. The C-shaped cross-section has a moment of inertia (98, 148, 238) of greater than 0.40, greater than 0.45, or at least 0.46. The top flange (96, 146, 220) includes an elevated portion (100, 150, 222) and a lower or shelf support portion (104, 154, 226) separated by a sidewall (106, 156, 230).

29 Claims, 14 Drawing Sheets

(51) Int. Cl.
*A47B 96/02* (2006.01)
*A47B 96/14* (2006.01)

(52) U.S. Cl.
CPC ..... *A47B 96/021* (2013.01); *A47B 96/1441* (2013.01); *A47B 47/0058* (2013.01)

(56) References Cited

U.S. PATENT DOCUMENTS

| | | | | |
|---|---|---|---|---|
| 3,999,875 | A | 12/1976 | Simon | |
| 4,233,912 | A | 11/1980 | Ferdinand | |
| 5,407,170 | A | 4/1995 | Slivon et al. | |
| 5,553,549 | A | 9/1996 | Nilsson | |
| D438,448 | S | 3/2001 | Batting et al. | |
| D570,208 | S | 6/2008 | Senn | |
| D597,353 | S | 8/2009 | Liss et al. | |
| D600,362 | S | 9/2009 | Geffe | |
| 7,591,385 | B2 | 9/2009 | Brooks | |
| D668,945 | S | 10/2012 | Fernandez | |
| 8,695,816 | B2 | 4/2014 | Troyner et al. | |
| D733,473 | S | 7/2015 | Troyner et al. | |
| D737,613 | S | 9/2015 | Troyner et al. | |
| 9,215,926 | B1 * | 12/2015 | Offerman | A47B 47/03 |
| 9,215,931 | B1 * | 12/2015 | Offerman | A47B 96/02 |
| 9,386,855 | B2 * | 7/2016 | Sabounjian | A47B 96/14 |
| D769,037 | S * | 10/2016 | Anderson | D6/705 |
| 9,713,379 | B1 * | 7/2017 | Tsai | A47B 96/024 |
| 9,750,347 | B2 | 9/2017 | Nuckolls | |
| D799,870 | S | 10/2017 | Liss | |
| D877,603 | S | 3/2020 | Barker | |
| D886,920 | S | 6/2020 | Dunahay | |
| 10,806,257 | B1 | 10/2020 | Liu | |
| D907,946 | S * | 1/2021 | Parab | D6/675.5 |
| D922,809 | S | 6/2021 | Parab et al. | |
| 2005/0103733 | A1 | 5/2005 | Saltzberg et al. | |
| 2005/0103734 | A1 | 5/2005 | Saltzberg et al. | |
| 2006/0175274 | A1 | 8/2006 | Yang | |
| 2010/0084354 | A1 | 4/2010 | Eustace | |
| 2012/0000871 | A1 | 1/2012 | Troyner et al. | |
| 2012/0067838 | A1 * | 3/2012 | Lawson | A47B 47/028 211/183 |
| 2014/0116973 | A1 | 5/2014 | Buckley et al. | |
| 2015/0090683 | A1 * | 4/2015 | Sabounjian | A47B 96/14 211/186 |
| 2015/0282613 | A1 | 10/2015 | Chen | |
| 2015/0359330 | A1 * | 12/2015 | Offerman | B65G 1/02 211/186 |
| 2017/0208946 | A1 * | 7/2017 | Tsai | A47B 96/1441 |
| 2017/0208948 | A1 * | 7/2017 | Tsai | A47B 96/06 |
| 2017/0238703 | A1 | 8/2017 | Tsai | |
| 2017/0347793 | A1 | 12/2017 | Wang | |
| 2018/0171634 | A1 | 6/2018 | Mitchell et al. | |
| 2018/0279782 | A1 | 10/2018 | Liss et al. | |
| 2018/0344031 | A1 | 12/2018 | Wang | |
| 2019/0125077 | A1 | 5/2019 | Liss et al. | |
| 2019/0328134 | A1 | 10/2019 | Walker | |
| 2020/0359789 | A1 | 11/2020 | O'Halloran | |
| 2022/0031066 | A1 | 2/2022 | Parab et al. | |

OTHER PUBLICATIONS

The International Bureau of WIPO, International Preliminary Report on Patentability in PCT Application No. PCT/US2020/029236, dated Nov. 4, 2021.

U.S. Patent and Trademark Office, Office Action issued in related U.S. Appl. No. 17/264,387 dated Mar. 22, 2022, 32 pages.

Storage Rack Beam, www.globalindustrial.com <http://www.globalindustrial.com> [online]. Published on or before Aug. 1, 2020, [retrieved on Aug. 1, 2020]. Retrieved from the Internet: <URL:<https://www.globalindustrial.conn/p/storage/bulk-rack/extra-heavy-duty/interlake-bulk-storage-rack-beam-zs-48-inch-I-for-metal-shelves>> (Year: 2020).

Dahlstrom u-channel, www.dahlstromrollform.com <http://www.dahlstromrollform.com> [online]. Published on or before Sep. 24, 2020, [retrieved on Sep. 24, 2020]. Retrieved from the Internet: <URL:<https://www.dahlstronnrollfornn.conn/wp-content/uploads/2019/05/u-channel.pdf>> (Year: 2020).

* cited by examiner

SHELF SUPPORT BEAMS AND SHELVING UNITS UTILIZING SAME

TECHNICAL FIELD

This invention relates to shelving units, and more particularly to shelf support beams to increase the load-bearing capacity of shelving units.

BACKGROUND

Shelving units are commonly used for storing various items in a space-efficient manner. Such units typically include four vertical support posts arranged at corners of a generally rectangular pattern. Horizontal front and rear shelf support beams extend between the two front corner support posts and between the two rear corner support posts. Shorter horizontal shelf support beams are often positioned on opposing sides of the unit and extend between a front corner support post and a rear corner support post. In a conventional arrangement, such shelving units define multiple shelves and supporting beams one above the other with the corner support posts and shelf support beams of metal. For example, these components are often formed of sheet metal or steel and, in combination with shelves, are generally referred to as steel shelving or storage units.

As loads are applied to a shelving unit, such as by loading heavy items onto a shelf, each shelf may bow or bend. Bowing and bending beyond a limit can lead to shelving failure, particularly when bowing results in strain beyond the unit's capacity. For example, undue bowing or bending of a shelving unit under load could permanently deform the shelf, allowing the shelf to pull away from the shelf support beams of the shelving unit thereby rendering the shelf and/or shelving unit inoperable for future use, or the shelf could catastrophically fail.

While metal shelving units are generally successful for their intended purpose and remain useful and popular with consumers, manufacturers and other providers continually strive to improve upon their design and load-carrying capacity. In this regard, it is desirable to significantly increase the load capacity of shelving units without a significant increase in manufacturing cost and/or without a significant increase in weight of the shelving unit.

SUMMARY

Embodiments in accordance with the invention address these and other deficiencies in conventional metal shelving units by at least significantly increasing the load capacity relative to existing metal shelving units without increasing related material or manufacturing costs. In one embodiment, a shelf support beam for use in a shelving unit to support a shelf includes a structural member having a C-shaped cross-section. In the cross-section, a web separates a top flange from a bottom flange. The top flange is configured to support the shelf. The web, the top flange, and the bottom flange define a channel. The channel defines a cavity height. And, the top flange and the bottom flange define a top flange width and a bottom flange width, respectively. A ratio of the cavity height to a sum of the top flange width and the bottom flange width is greater than 1.

In one embodiment, the C-shaped cross-section has a moment of inertia of greater than 0.40.

In one embodiment, the C-shaped cross-section has a moment of inertia of greater than 0.45.

In one embodiment, the C-shaped cross-section has a moment of inertia of at least 0.46.

In one embodiment, the top flange includes an elevated portion and a lower or shelf support portion separated by a sidewall and having an S-shaped configuration with the shelf support portion being configured to support the shelf and the sidewall being configured to prevent lateral motion of the shelf toward the web. The cavity height is defined between the shelf support portion and the bottom flange.

In one embodiment, the ratio is at least 1.20.

In one embodiment, the ratio is about 1.40.

In one embodiment, the cavity height is greater than 2.50 inches (6.35 centimeters) and is less than 5.375 inches (13.65 centimeters).

In one embodiment, the C-shaped cross-section has a centroid and the centroid is within 0.25 inch (0.635 centimeter) of the web.

In one embodiment, the web includes a recessed region in which the structural member is offset in a direction into the channel.

In one embodiment, the recessed region is at least 50% of the overall height of the structural member.

In one embodiment, the recessed region is in a range of 50% to 70% of the overall height of the structural member.

In one embodiment, the recessed region is at least 70% of the overall height of the structural member.

In one embodiment, the web includes a recessed region in which the structural member is offset in a direction into the channel and wherein the C-shaped cross-section has a centroid and the centroid is within 0.125 inch (0.3175 centimeter) of the recessed region.

In one embodiment, the recessed region is at least 50% of the overall height of the structural member.

In one embodiment, the recessed region is in a range of 50% to 70% of the overall height of the structural member.

In one embodiment, the recessed region is at least 70% of the overall height of the structural member.

In one embodiment, the C-shaped cross-section has a gauge of 0.054 inch (0.1372 centimeter).

In one embodiment, the C-shaped cross-section has a strip width of 5.735 inch (14.57 centimeters).

In one embodiment, the C-shaped cross-section has a strip width of 0.054 inch (0.1372 centimeter).

In one embodiment, a shelving unit includes a plurality of posts; and a plurality of shelf support beams of any one of the embodiments identified above attached to the plurality of posts. A shelf is seated on the shelf support beams.

According to one aspect of the invention, there is a method of manufacturing a shelf support beam of any one of the embodiments identified above.

In an embodiment, a shelf support beam for use in a shelving unit to support a shelf includes a structural member having a C-shaped cross-section. In the cross-section a web separates a top flange that is configured to support the shelf from a bottom flange. The web, the top flange, and the bottom flange define a channel. The C-shaped cross-section has a moment of inertia greater than 0.40.

In one embodiment, the C-shaped cross-section has an overall height of greater than 2.977 inches (7.562 centimeters).

In one embodiment, the C-shaped cross-section has a moment of inertia of greater than 0.45.

In one embodiment, the C-shaped cross-section has a moment of inertia of at least 0.46.

In one embodiment, the C-shaped cross-section has a strip width of 5.735 inches (14.57 centimeters).

In one embodiment, the C-shaped cross-section has a gauge of 0.054 inch (0.1372 centimeter).

In one embodiment, the top flange includes an elevated portion and a lower or shelf support portion separated by a sidewall and having an S-shaped configuration. The shelf support portion is configured to support the shelf and the sidewall is configured to prevent lateral motion of the shelf toward the web. The cavity height is defined between the shelf support portion and the bottom flange.

In one embodiment, the channel has a cavity height, the top flange, and the bottom flange define a top flange width and a bottom flange width, respectively. A ratio of the cavity height to a sum of the top flange width and the bottom flange width is greater than 1.

In one embodiment, the ratio is at least 1.20.

In one embodiment, the ratio is about 1.40.

In one embodiment, a shelving unit includes a plurality of posts; a plurality of shelf support beams of any one of the embodiments identified above attached to the plurality of posts; and a shelf seated on the shelf support beams.

According to one aspect of the invention, there is a method of manufacturing a shelf support beam of any one of the embodiments identified above.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the detailed description given below, serve to explain the one or more embodiments of the invention.

DETAILED DESCRIPTION

Figure 1:
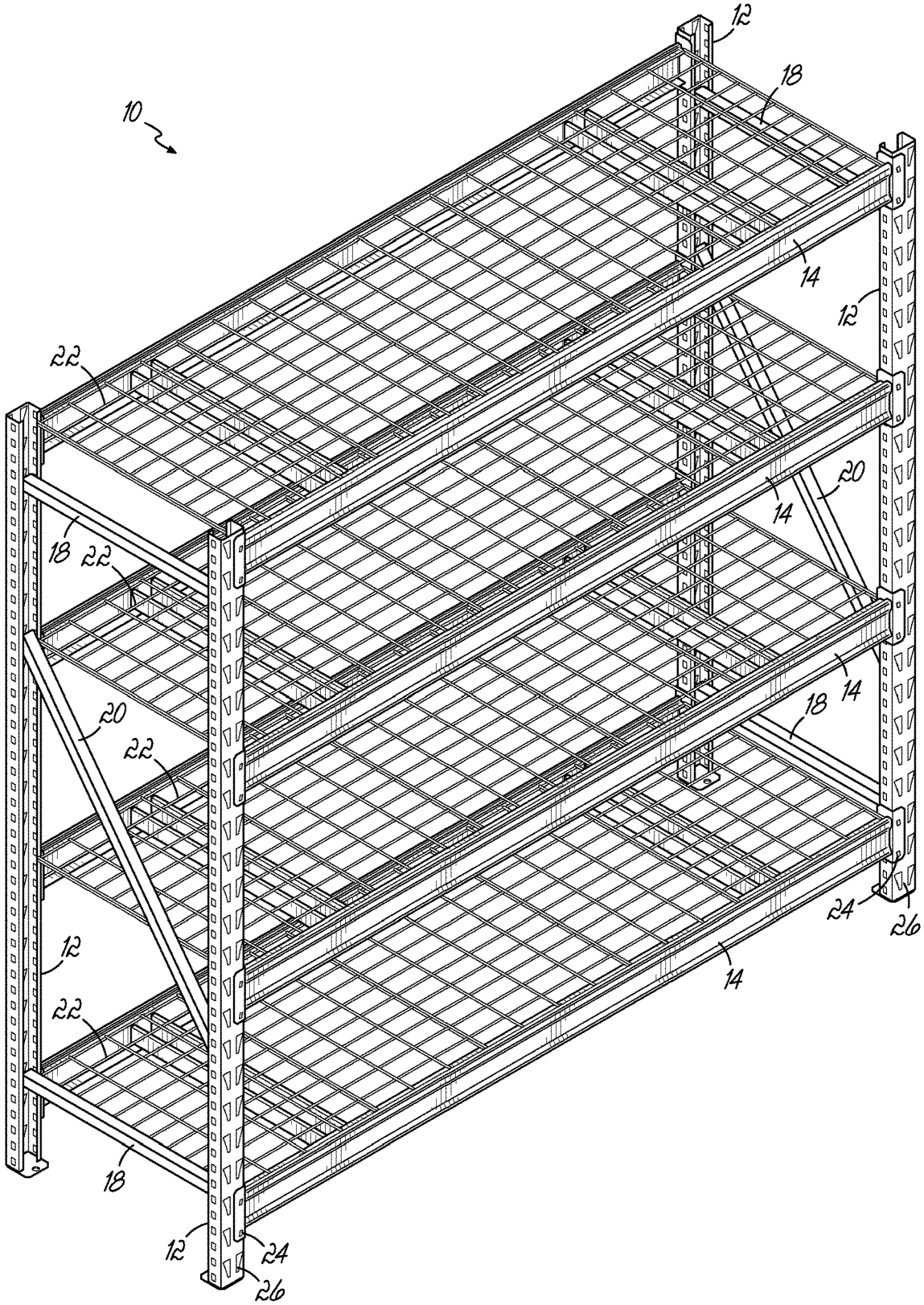
FIG. 1 is an isometric view of an exemplary shelving unit in accordance with an embodiment of the invention.

To these and other ends, in one embodiment and with reference to FIG. 1, a shelving unit 10 includes four corner posts 12 arranged in a generally rectangular configuration. A front pair of corner posts 12 cooperate to carry a front horizontal shelf support beam 14, and a rear pair of corner posts 12 cooperate to carry a rear horizontal shelf support beam 14. As is described in detail below, one or both of the front and rear shelf support beams 14 is configured to carry a substantially higher load than existing support beams. Applicant discovered that deflection of the shelf support beam 14 is minimized (i.e., load carrying capacity maximized) when a moment of inertia for the shelf support beam 14 is maximized. Thus, according to embodiments of the present invention horizontal shelf support beams have an increased moment of inertia relative to existing horizontal shelf support beams.

With continued reference to FIG. 1, one or more side rails 18 and/or diagonal braces 20 couple each front corner post 12 with a corresponding rear corner post 12. Although not shown, corner posts 12 can carry side horizontal shelf support beams in addition or as an alternative to the side rails 18 and/or diagonal braces 20. In this configuration, horizontal shelf support beams 14 would form an outer rim at one level of the shelving unit 10 and so extend between each post 12. By way of example only, horizontal shelf support beams are shown and described in commonly owned U.S. application Ser. No. 16/130,398, published as U.S. Pub. No. 2019/015077 on May 2, 2019, which is incorporated by reference herein in its entirety.

The horizontal shelf support beams 14 are configured to support a shelf 22. Items (not shown) may be stored on the shelf 22 in the normal course of using the shelving unit 10. These items produce a load due to gravity on each of the shelf support beams 14, which is transferred to the posts 12. One or more of the shelves 22 of the shelving unit 10, and preferably each of the shelves 22 of the shelving unit 10, may be configured as a wire rack. Other shelf configurations, such as solid shelves, are also possible.

In an exemplary embodiment, the horizontal shelf support beams 14 are configured to be selectively coupled to the posts 12 via releasable fastening means fully described in U.S. application Ser. No. 16/130,398. By way of example, each of the horizontal shelf support beams 14 may include one or more locking pins 24 that are configured to be received within corresponding H-shaped or V-shaped keyholes 26 that are distributed along the length of the corner posts 12. The horizontal shelf support beams 14 couple to the corner posts 12 at the keyholes 26 and may be moved vertically with respect to the posts 12 such that the number of horizontal shelf support beams 14 and their respective heights along the posts 12 may be varied. As shown, the shelving unit 10 includes four horizontal shelves 22 supported by shelf support beams 14 according to embodiments of the invention. However, it will be appreciated that any number of shelves 22 and corresponding horizontal shelf support beams 14 may be used.

As described above, according to aspects of the present invention, the horizontal shelf support beams 14 having increased load carrying capacity relative to existing support beams can be produced with little or no additional material. More particularly, such horizontal shelf support beams 14 can be produced with existing materials and existing resources, and can be produced in conformity with existing manufacturing techniques. Thus, embodiments of the invention do not significantly add to the manufacturing cost of the shelving unit 10 while providing superior loading performance. To these and other ends, Applicant discovered that maximizing a moment of inertia of a cross-section of a beam will increase the load carrying capacity of the shelf support beam 14 relative to existing beams.

Figure 2:
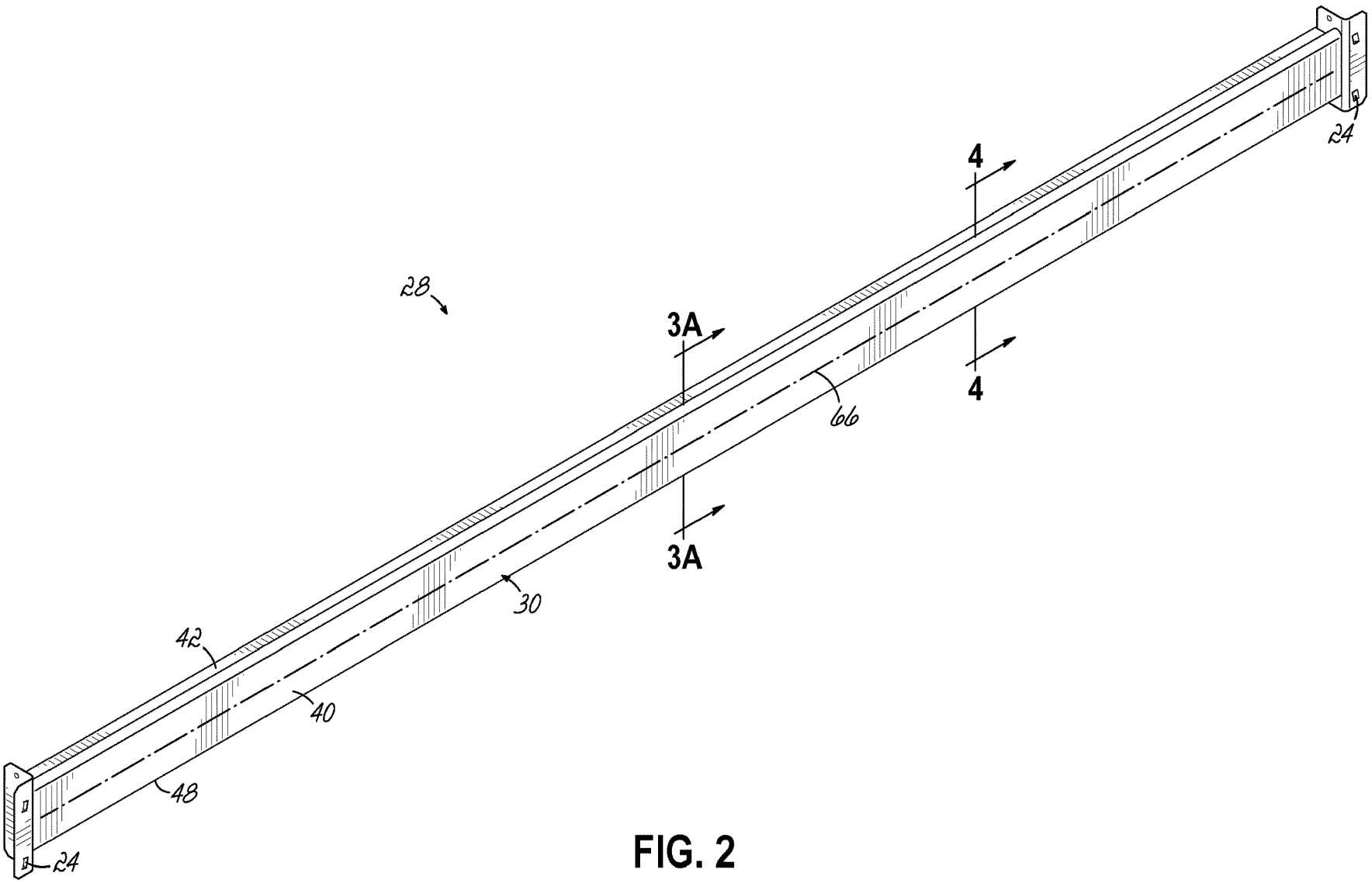
FIG. 2 is a perspective view of a shelf support beam.
Figure 3A:
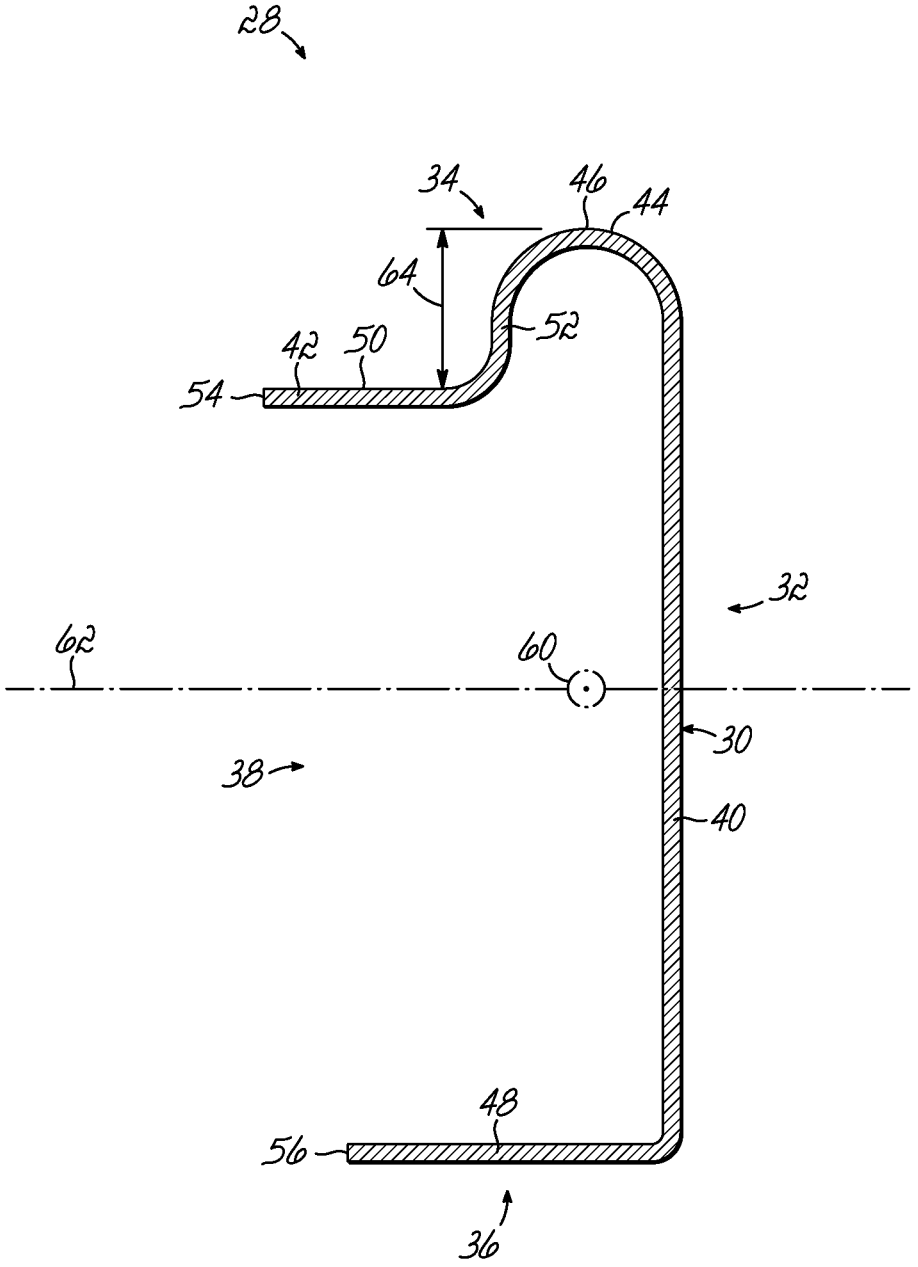
FIGS. 3A and 3B are cross-sectional views of a shelf support beam of FIG. 2.
Figure 3B:
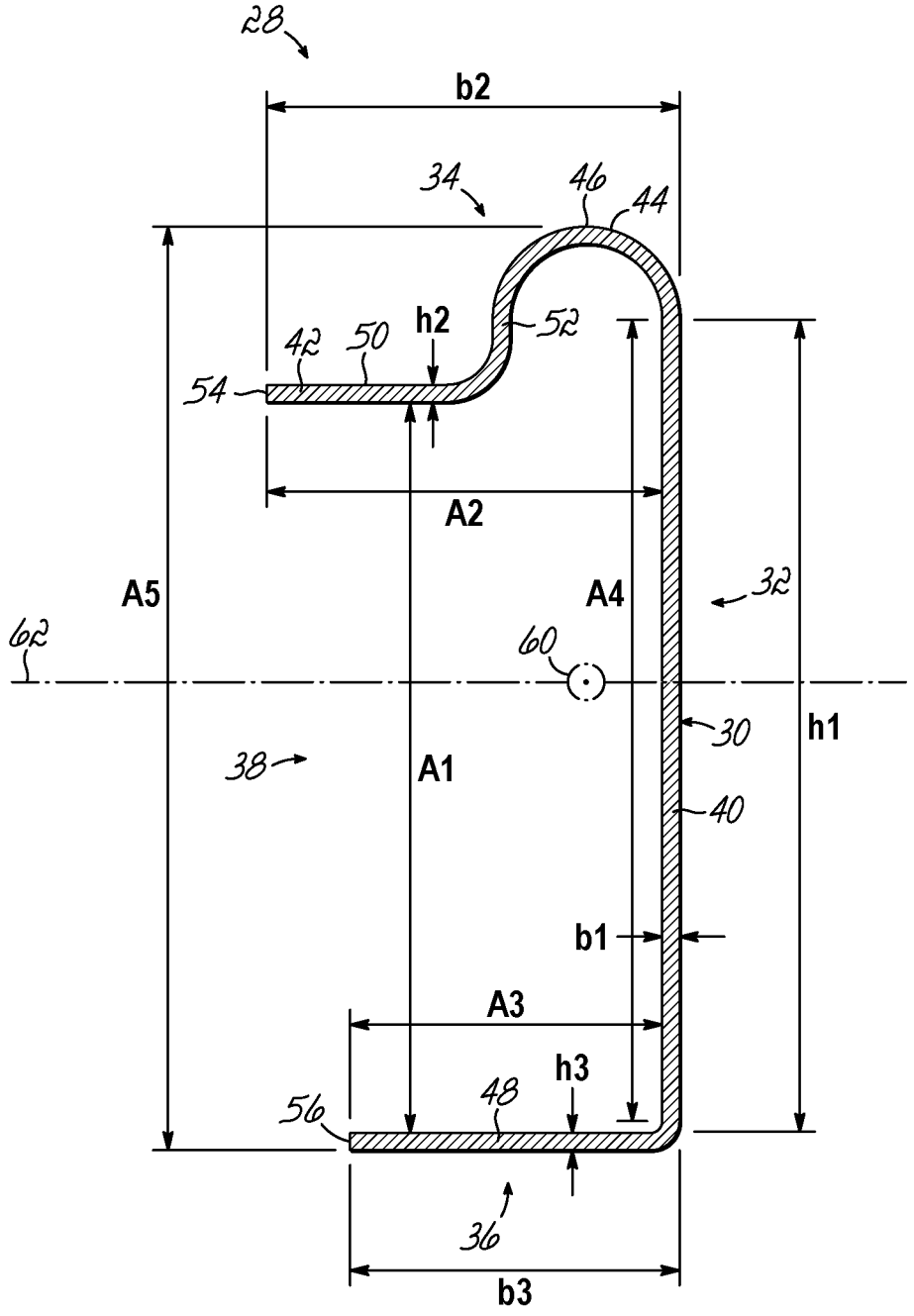

By way of comparison only and with reference to FIGS. 2, 3A, 3B, and 4, an exemplary existing beam 28 is shown. The existing shelf support beam 28 can be utilized in a shelving unit, such as that illustrated in FIG. 1. The existing shelf support beam 28 generally consists of a structural member 30 that is formed in a generally C-shape. Referring to FIGS. 3A and 3B, for purposes of calculating a moment of inertia of the cross-section of the structural member 30, the cross-section of the shelf support beam 28 may be visually sectioned into section 32, section 34, and section 36. The section 32 separates section 34 from section 36 to define a channel 38 therebetween. Overall, the arrangement of the sections 32, 34, 36 defines the C-shaped cross-sectional configuration of the structural member 30 and defines the channel 38.

In that C-shaped cross-sectional configuration, section 32 includes a web 40, which forms a vertical portion of the structural member 30 during use. The section 34 defines a top flange 42 and is configured to receive a shelf. The top flange 42 extends generally inwardly in a shelving unit (e.g., FIG. 1) and in a direction away from the web 40. The top flange 42 has an S-shaped configuration with an elevated portion 44 defining a top edge 46 and a lower portion 50. A sidewall 52 transitions from the elevated portion 44 to the lower portion 50 to provide the S-shaped configuration. A shelf is supported on lower portion 50 with the sidewall 52 providing a stop for lateral movement of the shelf in an outward direction (i.e., toward the web 40) in a shelving unit. A pair of existing shelf support beams 28 positioned on the front and rear sides of the shelf captures a shelf between opposing sidewalls 52 to prevent unwanted lateral movement of the shelf. Generally, a distance 64 between the top edge 46 and the shelf support 50 may be approximately a thickness of a shelf. The shelf is then approximately flush with the elevated portion 44, particularly the top edge 46. The elevated portion 44 may have a rounded or radiused configuration, and so appear as a semi-circle, as the structural member 30 transitions from the top edge 46 to the web 40. Section 36 defines a bottom flange 48 that joins the web 40 on an opposite end of the web 40 from the top flange 42. As shown, the web 40 may be radiused at each of the locations at which the structural member 30 transitions to the top flange 42 and to the bottom flange 48. The web 40 is defined in the structural member 30 from a location at which a tangent to the surface curvature of an inner surface of the top flange 42 is parallel to an inner surface of the web 40 at one end to a location at which a tangent to the surface curvature of an inner surface of the bottom flange 48 is parallel to the inner surface of the web 40 at the opposing end. Collectively, the top flange 42, the web 40, and the bottom flange 48 define the channel 38.

With reference to FIG. 3B, exemplary dimensions of the existing shelf support beam 28 are:

(1) a strip width of 5.735 inches (14.57 centimeters) (the strip width of the structural member 30 in the cross-section of FIG. 3A is the distance from one end 54 of the structural member 30 to the other end 56 along the structural member 30), (2) a weight of 6.8 pounds (3.084 kilograms), the weight is an approximation based on the available gage and dimensional variation of the strip from which the beam is made, (3) a cavity height (A1) (FIG. 3B) is the inside dimension between the top flange 42 at the lower portion 50 and the bottom flange 48) of 2.352 inches (5.974 centimeters), (4) a gauge of 0.054 inch (0.1372 centimeter), (5) a top flange width (A2) of 1.385 inches (3.518 centimeters) (as measured from the end 54 to the inwardly facing surface of the web 40), (6) a bottom flange width (A3) of 1.250 inches (3.175 centimeters) (as measured from the end 56 to the inwardly facing surface of the web 40), (7) a web height (A4) of 2.577 inches (6.546 centimeters), (8) an overall height (A5) of 2.977 inches (7.562 centimeters), and (9) a hardness of 12 on the Webster scale.

The moment of inertia for the shelf support beam 28 was calculated for each section 32, 34, and 36 of the beam 28 by determining a centroid of the cross-section and then summing the moments of inertia for each section. For example, with reference to FIGS. 3A and 3B, a centroid 60 is calculated. The centroid 60 establishes a neutral axis 62. The neutral axis 62 is generally perpendicular with a longitudinal axis 66 (FIG. 2) of the shelf support beam 28 though the two axes may not intersect. Individual moments of inertia, $I_x$, are calculated for each of sections 32, 34, and 36 about the neutral axis 62 according to:

$$I_x = I_C + Ad^2$$

where $I_C$ is the moment of inertia of the section 32 (i.e., $I_{32}$), the section 34 (i.e., $I_{34}$), or the section 36 (i.e., $I_{36}$) about the section's centroid, A is the area of the respective section 32, the section 34, or the section 36, and d is the vertical distance from the respective centroid (not shown) to the neutral axis 62 for each of the section 32, the section 34, or the section 36. Further, where sections 32, 34, 36 are approximated by rectangles then $$I_C = \frac{bh^3}{12}$$

in which "b" corresponds to the base or width dimension of the rectangle and "h" corresponds to the height dimension of the rectangle.

Considering the sections 32, 34, and 36 as rectangles, and with reference to FIG. 3B, the section 32 is approximated by a rectangle having dimensions b1 by h1, section 34 is approximated by a rectangle b2 by h2, and section 36 is approximated by a rectangle having dimensions b3 by h3. To calculate moment of inertias, $I_x$, of the individual sections 32, 34, and 36, a 3D CAD model of the beam was developed on SolidWorks 2015 and each section was calculated by the software. The moment of inertia, $I_c$, was also calculated by the software. Referring to FIGS. 3A and 3B, the moment of inertia for the cross section is calculated as the sum of the individual moments of inertia, $I_x$, (see Table 1) of each section 32, 34, and 36 according to:

$$I_{total} = I_{32} + I_{34} + I_{36}$$

TABLE 1

| Section | $I_C$ (in$^4$) | Ad$^2$(in$^4$) | $I_x$(in$^4$) |
|---|---|---|---|
| 32 | 0.09 | 0.002 | 0.092 |
| 34 | 0.02 | 0.130 | 0.150 |
| 36 | 0.01 | 0.151 | 0.161 |
| $I_{total}$ | | | 0.403 |

At a calculated moment of inertia of 0.403, the theoretical capacity of the existing shelf support beam 28 is determined by finite elemental analysis to be 1,734 pounds (786.5 kilograms). Finite elemental analysis was performed on Ansys® workbench software version 15.1 with a static structure analysis module. Pre-processing includes A36 Structural steel as a material assignment and a linear-elastic mechanical property. Meshing was tetrahedron fine mesh. A CAD model of a beam shown in FIGS. 2, 3A, 3B, and 4 with two brackets, one on each end was analyzed. Constraint principles of ANSI MH28.2-2012 standard where adhered to. Testing was completed with an R rating and a four-point flexural testing formula with a deflection limit of 0.399 inch (1.013 centimeters) under a four-point loading with fixed supports. The deflection limit was calculated using a formula of L/180, where L is a beam span of 71.750 inches (192.405 centimeters). Post-processing included total deformation with a direction deformation along width and along depth.

Figure 5:
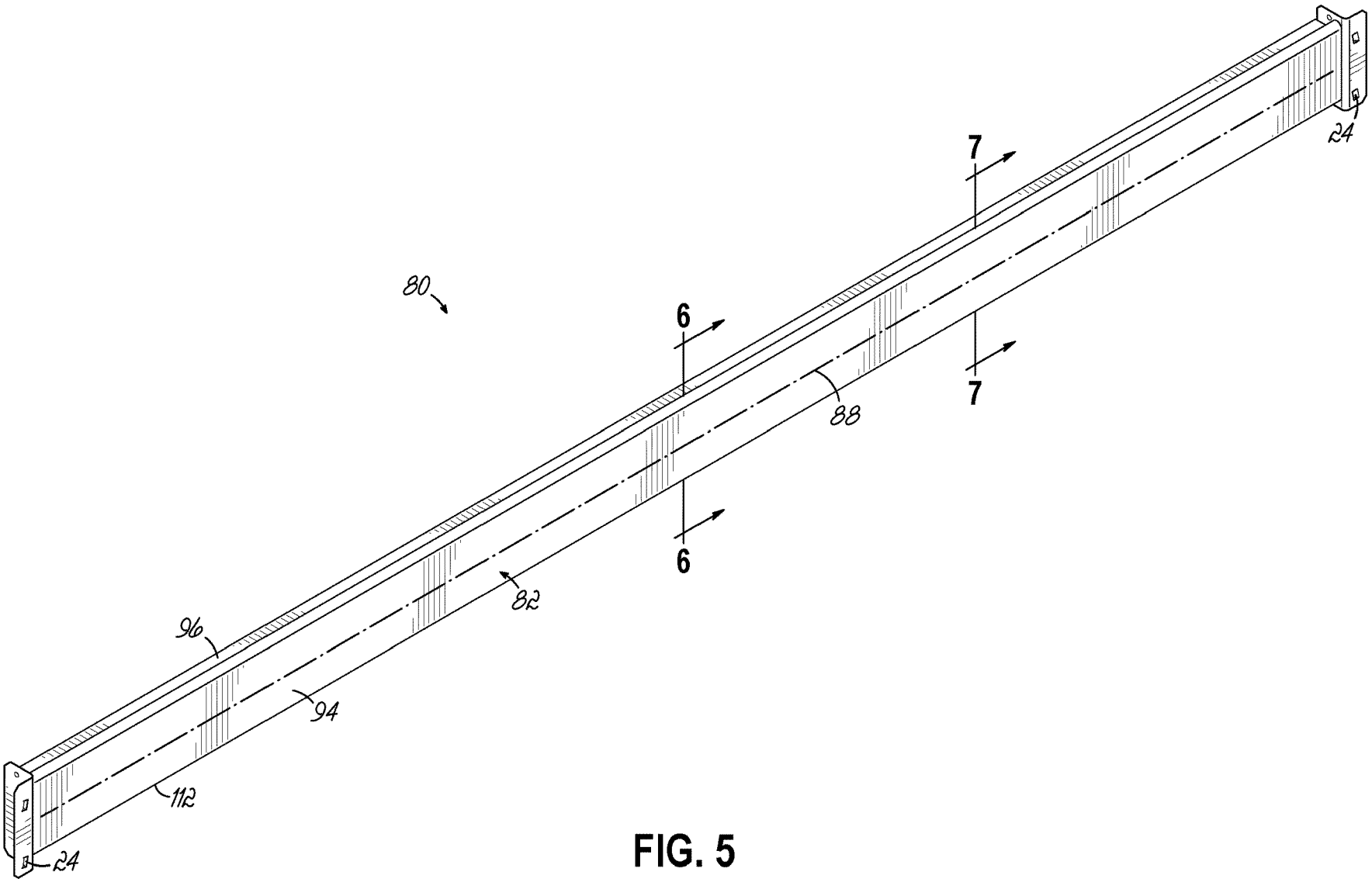
FIG. 5 is a perspective view of a shelf support beam according to one embodiment of the invention.
Figure 6:
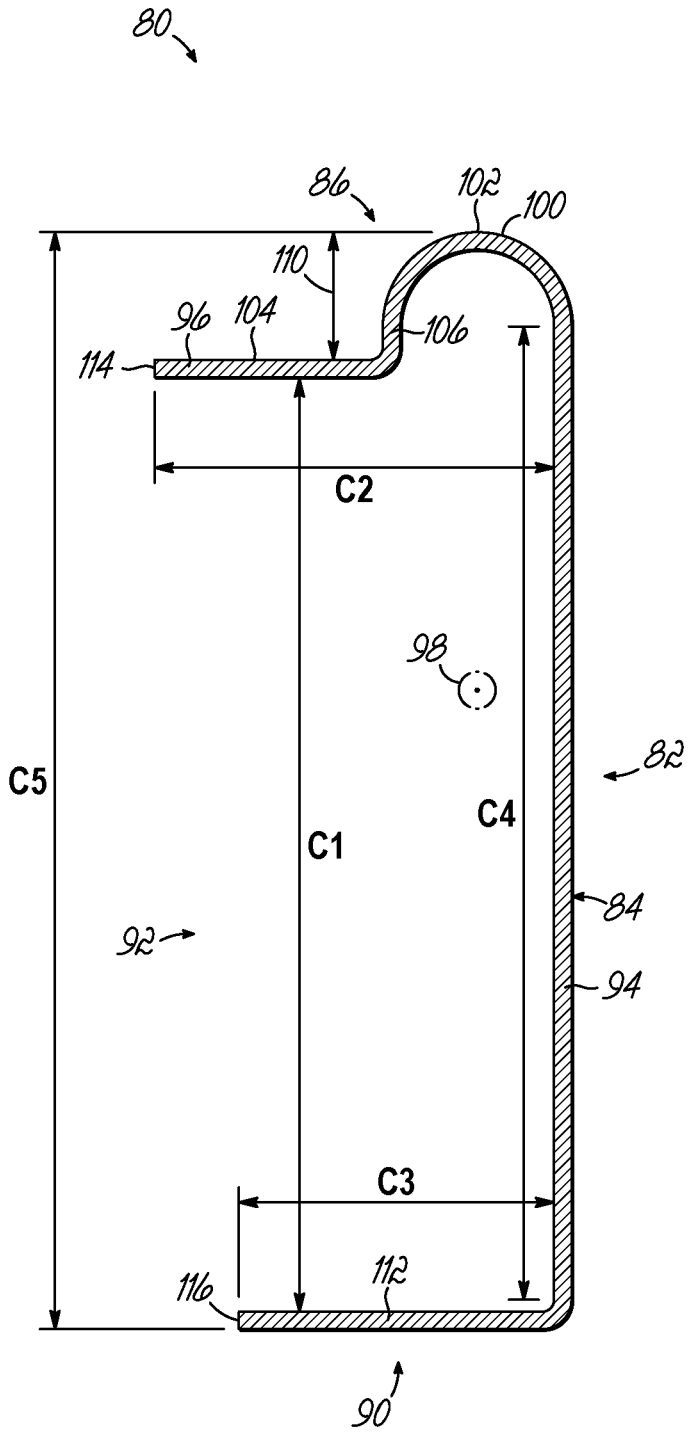
FIG. 6 is a cross-sectional view of the shelf support beam of FIG. 5 taken along section line 6-6.
Figure 7:
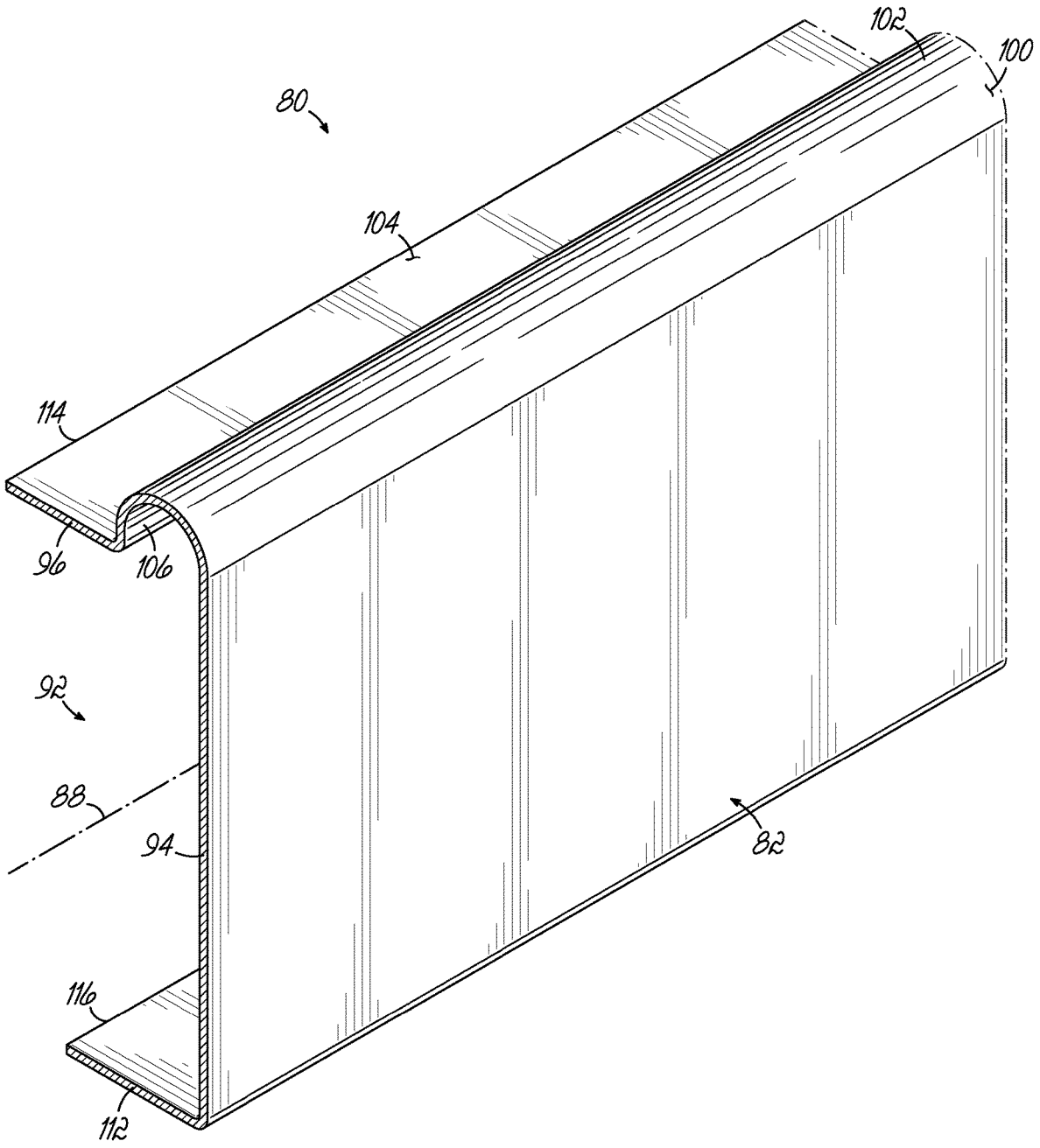
FIG. 7 is an isometric cross-sectional detail view taken along line 6-6 of FIG. 5 showing a portion of one embodiment of the invention.

With reference now to FIGS. 5, 6, and 7, in one embodiment of the invention, a shelf support beam 80 has a greater moment of inertia relative to the beam 28. The shelf support beam 80 corresponds to one embodiment of the shelf support beam 14 shown in FIG. 1.

Further in that regard, the shelf support beam 80 generally consists of a structural member 82 that is formed in a generally C-shaped and having a longitudinal axis 88. The exemplary shelf support beam 80 may be visually sectioned into three parts, i.e., section 84, section 86, and section 90 (see FIG. 6) for a moment of inertia calculation with the procedure set out above with respect to the shelf support beam 28 of FIGS. 2 and 3. The section 84 separates section 86 from section 90 and defines a channel 92. Overall, the arrangement of the sections 84, 86, 90 defines a C-shaped cross-sectional configuration.

In that C-shaped cross-sectional configuration, section 84 includes a web 94, which forms a vertical portion of the structural member 82 during use. The section 86 defines a top flange 96 and is configured to receive the shelf 22. The top flange 96 extends generally inwardly in the shelving unit 10 (e.g., FIG. 1), and thus in a direction away from the web 94, and has an S-shaped configuration with an elevated portion 100 defining a top edge 102 and a lower portion 104. A sidewall 106 transitions from the elevated portion 100 to the lower portion 104 to provide the S-shaped configuration. The shelf 22 is supported on lower portion 104 with the sidewall 106 providing a stop for lateral movement of the shelf in an outward direction (i.e., toward the web 94) in the shelving unit 10. A pair of opposing shelf support beams 80 on opposing sides of the shelving unit 10 thus captures the shelf 22 between sidewalls 106. Generally, a distance 110 between the top edge 102 and the shelf support 104 may be approximately a thickness of a shelf. The elevated portion 100 may have a rounded or radiused configuration as the structural member 82 transitions from the top edge 102 to the web 94.

Section 90 defines a bottom flange 112 that joins the web 94 on an opposite end of the web 94 from the top flange 96. As shown, the web 94 may be radiused at each of the locations at which the structural member 82 transitions to the top flange 96 and to the bottom flange 112. The web 94 is defined in the structural member 82 from a location at which a tangent to the surface curvature of an inner surface of the top flange 96 is parallel to an inner surface of the web 94 at one end to a location at which a tangent to the surface curvature of an inner surface of the bottom flange 112 is parallel to the inner surface of the web 94 at the opposing end. Collectively, the top flange 96, the web 94, and the bottom flange 112 define the channel 92 and a centroid 98, which is spaced apart from each of the top flange 96, the web 94, and the bottom flange 112. By way of example only, the centroid 98 is spaced apart from the nearest portion of the structural member 82 by less than 0.25 inch (0.635 centimeter).

With reference to FIG. 6, dimensions of an exemplary shelf support beam 80 are:

(1) a strip width of 5.735 inches (14.57 centimeters) (the strip width of the structural member 82 in the cross-section of FIG. 6 is the distance from one end 114 of the structural member 82 to another end 116 along the structural member 82), (2) a weight of 6.8 pounds (3.084 kilograms), the weight is an approximation based on the available gage and dimensional variation of the strip from which the beam is made, (3) a cavity height (C1) (the inside dimension between the top flange 96 at the lower portion 104 and the bottom flange 112) of 2.801 inches (7.115 centimeters), (4) a gauge of 0.054 inch (0.1372 centimeter), (5) a top flange width (C2) of 1.278 inches (3.246 centimeters) (as measured from the end 114 to the inwardly facing surface of the web 94), (6) a bottom flange width (C3) of 1.024 inches (2.601 centimeters) (as measured from the end 116 to the inwardly facing surface of the web 94), (7) a web height (C4) of 2.927 inches (7.435 centimeters), (8) an overall height (C5) of 3.314 inches (8.418 centimeters) and (9) a hardness of 12 on the Webster scale.

The moment of inertia for the beam 80 is calculated for each section of the beam 80 by determining a centroid of each section and then summing the moments of inertia for each section as described above with respect to the shelf support beam 28.

TABLE 2

| Section | $I_C$ (in$^4$) | Ad$^2$(in$^4$) | $I_x$(in$^4$) |
|---|---|---|---|
| 84 | 0.11 | 0.004 | 0.114 |
| 86 | 0.01 | 0.149 | 0.159 |
| 90 | 0.01 | 0.169 | 0.179 |
| $I_{total}$ | | | 0.452 |

The moment of inertia of the cross-section of the shelf support beam 80 is greater than 0.4, by way of example, it is at least 0.452. As shown in Table 2, the moment of inertia is calculated to be 0.452 or about 12% greater than the beam 28 of FIG. 2. As such, the theoretical capacity of the exemplary shelf support beam 80 is believed to be greater than the beam shown in FIG. 2 by at least about 15%.

As described above, the dimensions of the shelf support beam 80 are different than the shelf support beam 28 though the strip widths are the same. Despite being of equivalent strip widths, the different dimensions of the shelf support beam 80 produce a greater moment of inertia than the moment of inertia of the shelf support beam 28. By way of comparison, the overall height dimension C5 of the shelf support beam 80 is greater than the overall height dimension A5 of the beam 28 by at least 11% and, by way of further example, the overall height C5 may be greater than 3 inches (7.62 centimeters). In one embodiment, the overall height C5 of the shelf support beam 80 is about 3.30 inches (about 8.382 centimeters) (unless otherwise indicated herein with reference to dimensions "about" means a dimension that is ±0.01 of the stated dimension) (e.g., an exemplary height is 3.314 inches (8.418 centimeters), which is about 3.30 inches (about 8.382 centimeters)). However, the strip width remains the same at 5.735 inches (14.57 centimeters). For equivalent strip widths, the shelf support beam 80 shown in FIGS. 5, 6, and 7 has a greater load carrying capacity than the beam 28 of FIGS. 2-4.

By way of further comparison, the cavity height C1 of the web 94 is greater than the cavity height A1 of the web 40 (FIG. 3). By way of example only, the cavity height C1 is greater than 2.50 inches (6.35 centimeters). Where the strip width remains the same for each of the shelf support beams 28 and 80, lengthening the web 94 relative to the web 40 to increase the cavity height requires a reduction in width dimensions of one or both of the flanges 96 and 112. In the exemplary embodiment, and by way of example only, the top flange 96 measures 1.278 inches (3.246 centimeters) (C2) as compared to the top flange 42, which measures 1.385 inches (3.518 centimeters) (A2). In the shelf support beam 80, the bottom flange 112 measures 1.024 inches (2.601 centimeters) (C3) as compared to the dimension of the bottom flange 48, which measures 1.250 inches (3.175 centimeters) (A3). A ratio of the dimensions of the cavity height relative to a sum of widths of the top flange and the bottom flange for the shelf support beam 80 shown in FIGS. 5-7 is about 1.23 (see FIG. 6, e.g., dimension C1 of 2.801 inches (7.115 centimeters) to dimension C3 of 1.024 inches (2.601 centimeters) plus dimension C2 of 1.278 inches (3.246 centimeters) (total of 2.302 inches (5.847 centimeters)) is 1.217, which is about 1.22).

Figure 4:
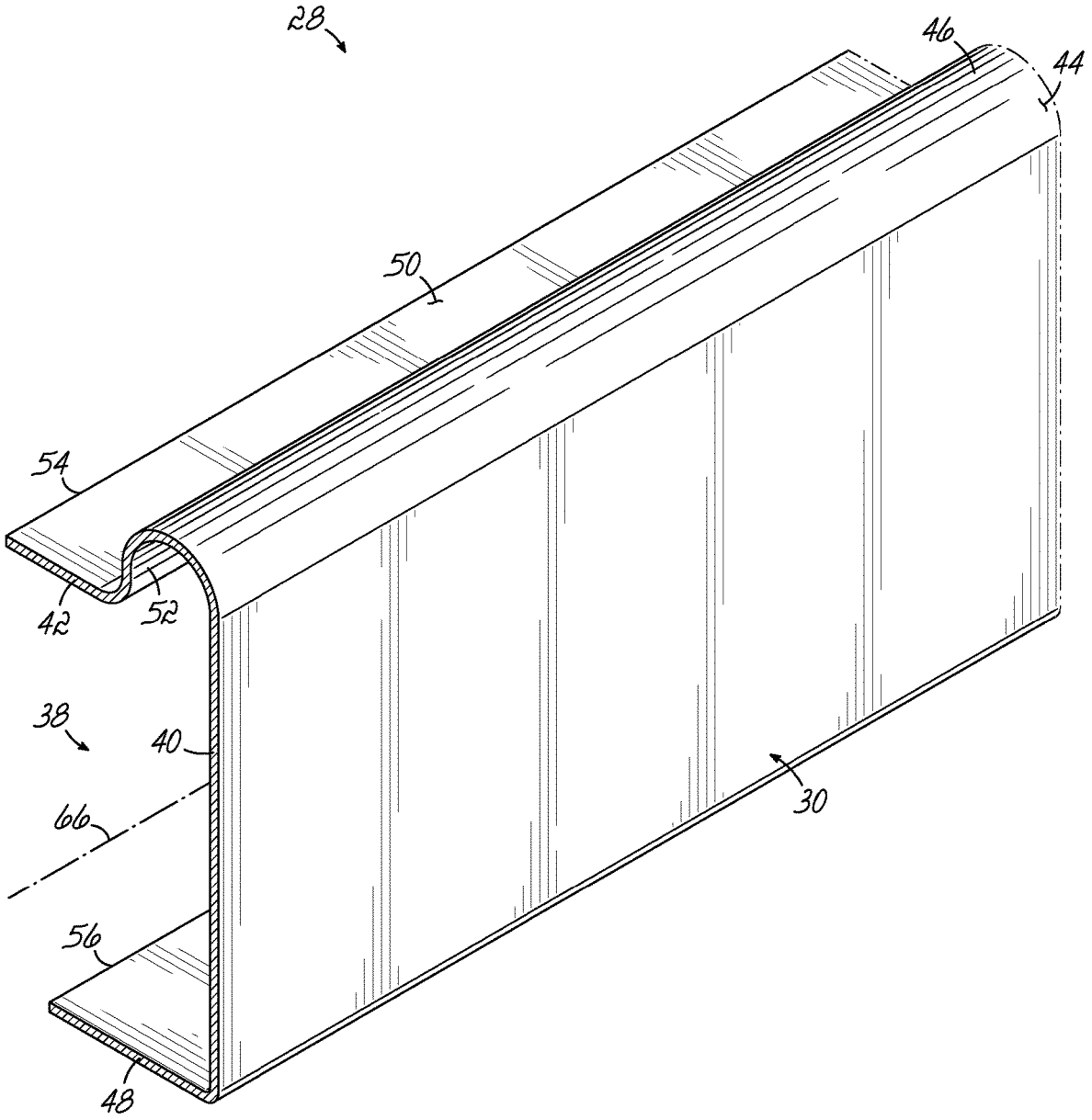
FIG. 4 is an isometric cross-sectional detail view taken along line 4-4 of FIG. 2 showing a portion of one embodiment of the invention.

By comparison, for the shelf support beam 28 of FIGS. 2-4, a ratio of the cavity height relative to the sum of the widths of the top flange and the bottom flange is about 0.9 (see FIG. 3B, e.g., dimension A1 of 2.352 inches (5.974 centimeters) to dimension A3 of 1.250 inches (3.175 centimeters) plus dimension A2 of 1.385 inches (3.518 centimeters) (total of 2.635 inches (6.693 centimeters)) is 0.893, which is about 0.9).

In one embodiment of the invention, the shelf support beam 80 has a ratio of cavity height to the sum of flange widths of greater than 1. That is, the web height is greater than the sum of the flange widths. Advantageously, the shelf support beam 80 may be produced from the same material stock as the shelf support beam 28 though the shelf support beam 80 is capable of carrying greater loads.

Figure 8:
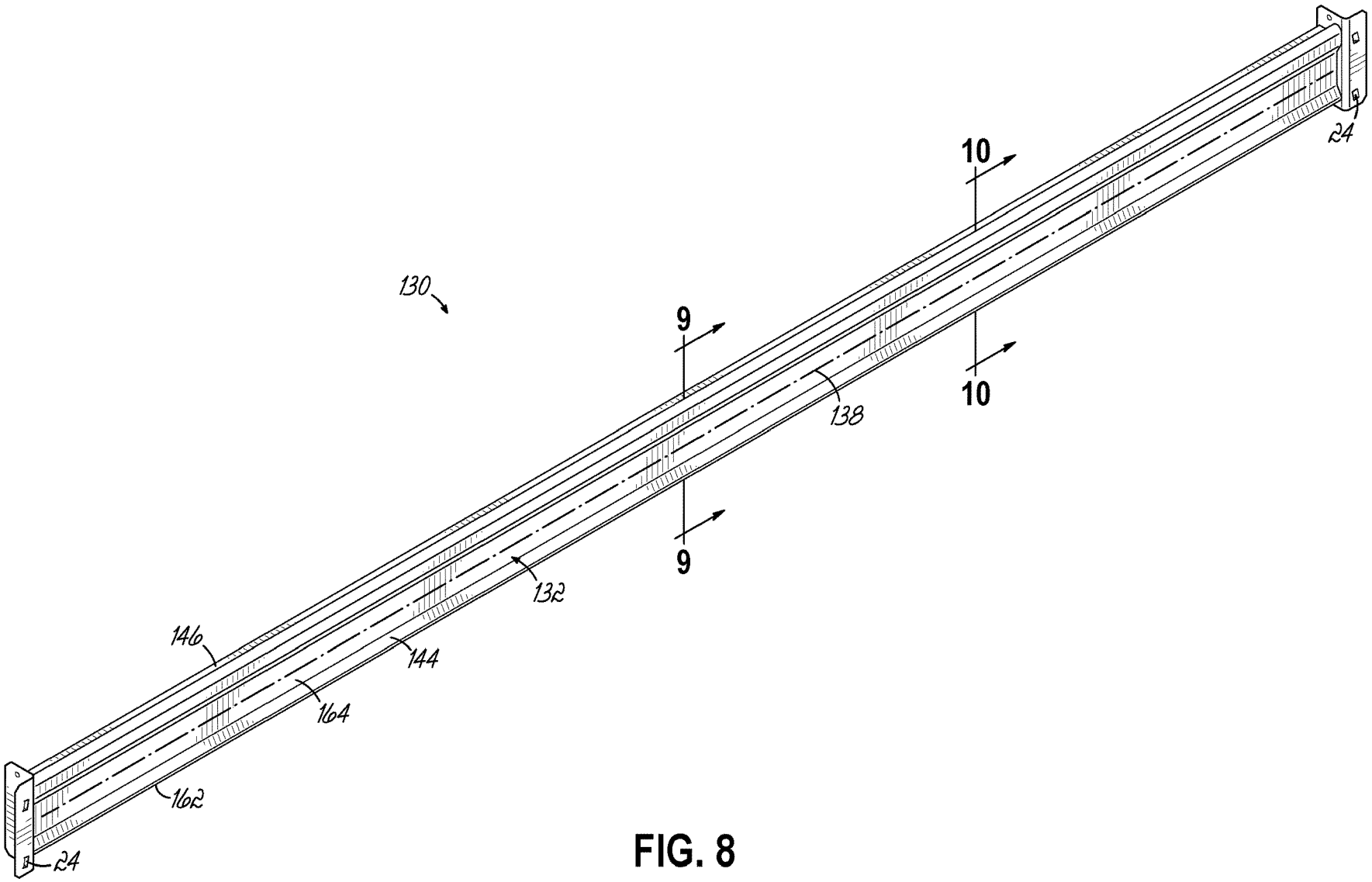
FIG. 8 is a perspective view of a shelf support beam of FIG. 1 according to one embodiment of the invention.
Figure 9:
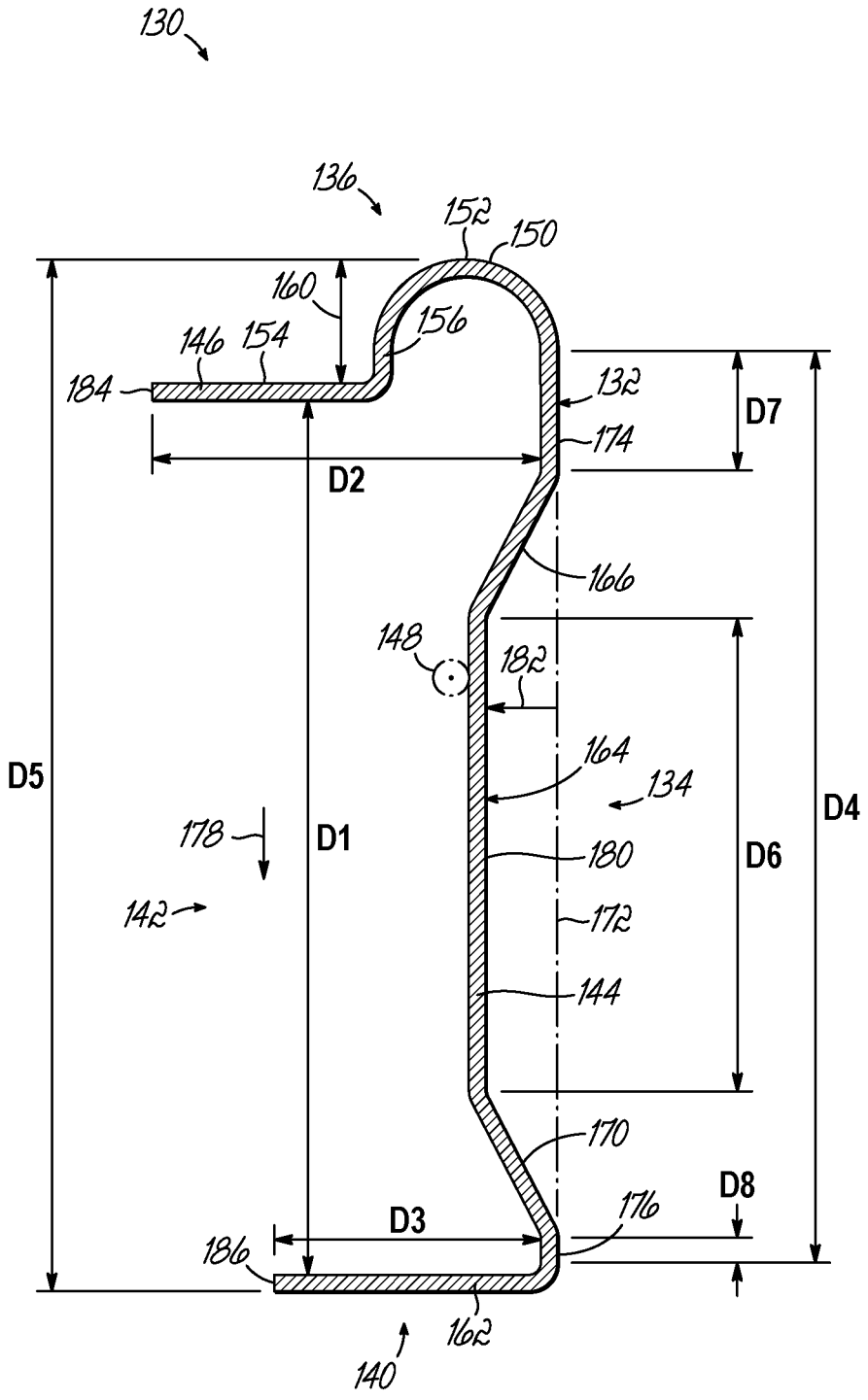
FIG. 9 is a cross-sectional view of a shelf support beam of FIG. 8 taken along section line 9-9.
Figure 10:
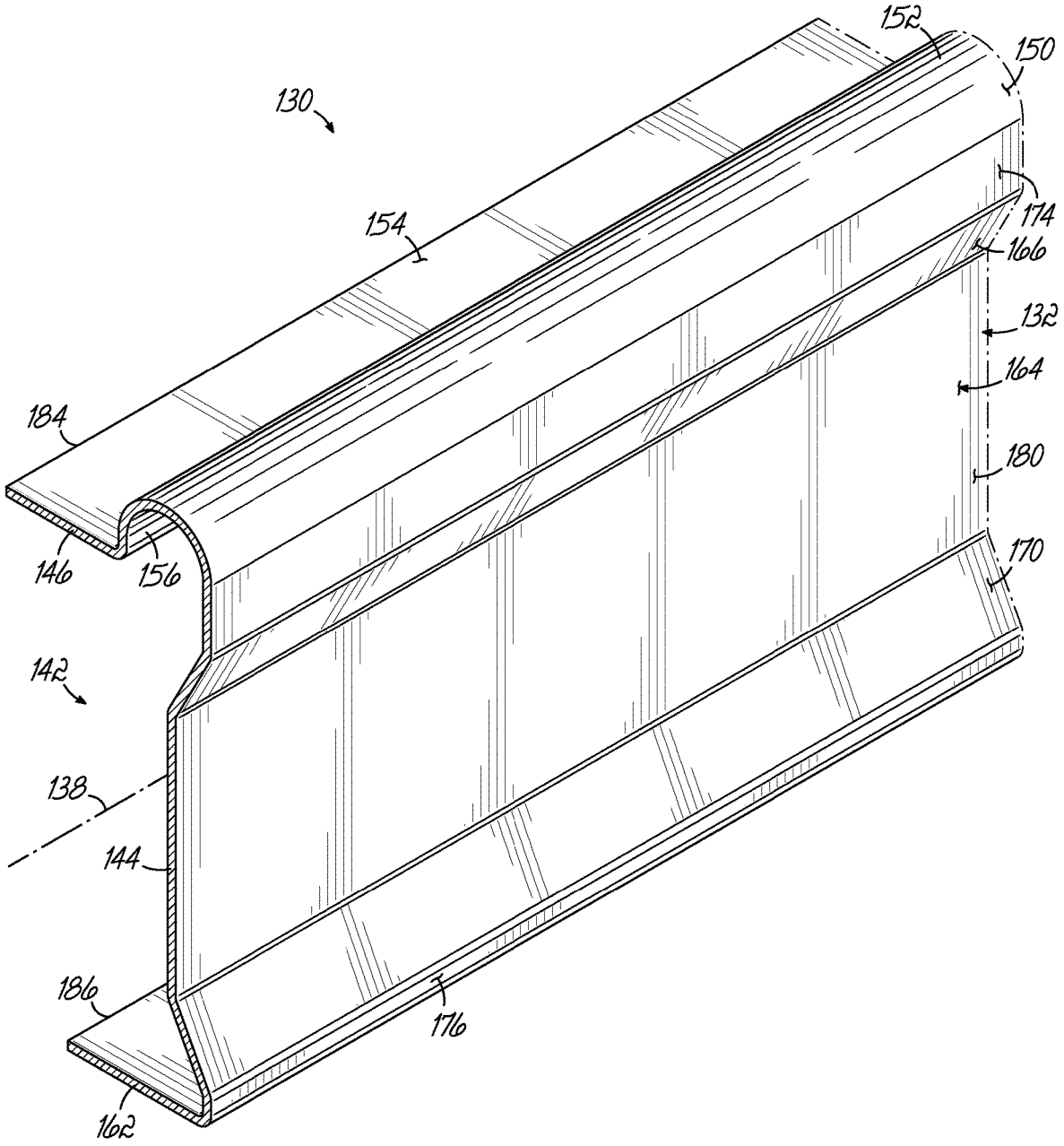
FIG. 10 is an isometric cross-sectional detail view taken along line 10-10 of FIG. 8 showing a portion of one embodiment of the invention.

With reference now to FIGS. 8, 9, and 10, in one embodiment of the invention, a shelf support beam 130 has a greater moment of inertia relative to the beam 28. The shelf support beam 130 is one embodiment of the shelf support beams 14 shown in FIG. 1. Further in that regard, the shelf support beam 130 generally consists of a structural member 132 that is formed in a generally C-shaped and having a longitudinal axis 138. The exemplary shelf support beam 130 may be visually sectioned into three parts, i.e., section 134, section 136, and section 140 (see FIG. 9) for a moment of inertia calculation with the procedure set out above with respect to the shelf support beam 28 of FIGS. 2 and 3. The section 134 separates section 136 from section 140 and defines a channel 142. Overall, the arrangement of the sections 134, 136, and 140 defines a C-shaped cross-sectional configuration.

In that C-shaped cross-sectional configuration, section 134 includes a web 144, which forms a vertical portion of the structural member 132 during use. The section 134 defines a top flange 146 and is configured to receive the shelf 22. The top flange 146 extends generally inwardly in the shelving unit 10 (e.g., FIG. 1), and thus in a direction away from the web 144, and has an S-shaped configuration with an elevated portion 150 defining a top edge 152 and a lower portion 154. A sidewall 156 transitions from the elevated portion 150 to the lower portion 154 to provide the S-shaped configuration. The shelf 22 is supported on lower portion 154 with the sidewall 156 providing a stop for lateral movement of the shelf 22 in an outward direction (i.e., toward the web 144) in the shelving unit 10. A pair of opposing shelf support beams 130 on opposing sides of the shelving unit 10 thus captures the shelf 22 between sidewalls 156. Generally, a distance 160 between the top edge 152 and the shelf support 154 may be approximately a thickness of a shelf. The elevated portion 150 may have a rounded or radiused configuration as the structural member 132 transitions from the top edge 152 to the web 144.

Section 140 defines a bottom flange 162 that joins the web 144 on an opposite end of the web 144 from the top flange 146. As shown, the web 144 may be radiused at each of the locations at which the structural member 132 transitions to the top flange 146 and to the bottom flange 162. The web 144 is defined in the structural member 132 from a location at which a tangent to the surface curvature of an inner surface of the top flange 146 is parallel to an inner surface of the web 144 at one end to a location at which a tangent to the surface curvature of an inner surface of the bottom flange 162 is parallel to the inner surface of the web 144 at the opposing end. Collectively, the top flange 146, the web 144, and the bottom flange 162 define the channel 142 and a centroid 148, which is spaced apart from each of the top flange 146, the web 144, and the bottom flange 162. By way of example, the centroid 148 may be located within 0.25 inch (0.635 centimeter) of the structural member 132 and more particularly the web 144.

With reference to FIGS. 9 and 10, the web 144 includes a recessed region 164 that runs along substantially (e.g., 80% or more, 90% or more, and probably greater than 95%) the entire longitudinal length of the shelf support beam 130 as is shown in FIG. 8. Further, the location of the recessed region 164 that has a length less than the entire longitudinal length relative to the longitudinal length may be symmetrically positioned in which a midpoint of the recessed region 164 is aligned with a midpoint of the longitudinal length of the shelf support beam 130. Embodiments of the invention are, however, not limited to a symmetrically positioned recessed region 164. In the exemplary embodiment shown, the recessed region 164 is defined by a pair of outwardly facing sidewalls 166 and 170, which are angled relative to a plane 172 that defines an outer-most surface of the web 144. The opposing sidewalls 166 and 170 intersect a base surface 180.

While the recessed region 164 may decrease the overall height of the shelf support beam 130 (i.e., relative to the shelf support beam 80 shown in FIGS. 5-7 for an equivalent strip width), the recessed region 164 results in an offset 182 of the structural member 132 along a portion of the web 144 in the direction of the channel 142. This offset 182 increases the moment of inertia of the structural member 132 by a greater degree than any loss in the moment of inertia due to a decrease in overall height dimension of the web 144. While a faceted recessed region 164 (i.e., defined by planar surfaces 166, 170, 180) is shown, the recessed region 164 may have other configurations, such as being rounded, or may have multiple other surfaces that define a portion of the web 144 that is offset from the plane 172 in a direction into the channel 142 and effectively decreasing the depth of the channel 142. In the embodiment shown in FIG. 9, the web 144 and the centroid 148 overlap at the recessed region 164 or the recessed region 164 may be within 0.125 inch (0.3175 centimeter) of the centroid 148.

With reference to FIGS. 9 and 10, the recessed region 164 divides the web 144 into spaced apart outer portions at 174 and 176. The spaced apart outer portions 174 and 176 define the plane 172. In the exemplary embodiment, the base surface 180 is generally parallel to the plane 172 with each of the opposing sidewalls 166 and 170 having approximately the same dimensions and angles. With reference to FIG. 9, by way of example, the base surface 180 may be at least 40% of an overall height of the cross-section of the shelf support beam 130. By way of further example, the recessed region 164 may be more than 50% of the overall height of the cross-section. The recessed region 164 may form about 70% of the overall height of the structural member 132.

With reference to FIG. 9, the recessed region 164 may appear to be symmetrical around a centerline of the recessed region 164. However, embodiments of the present invention are not limited to a symmetrical recessed region 164. Moreover, the recessed region 164 need not be symmetrically positioned within the web 144. Although embodiments of the invention are not limited to the spacing shown, in FIG. 9 the recessed region 164 is offset relative to the top flange 146 and the bottom flange 162 as is indicated by arrow 178 with the recessed region 164 being positioned closer to the bottom flange 162. Advantageously, the shelf support beam 130 has a greater moment of inertia than the shelf support beam 28 shown in FIGS. 2 and 3 as is set out below.

With reference to FIG. 9, dimensions of an exemplary shelf support beam 130 are:

(1) a strip width of 5.735 inches (14.57 centimeters) (the strip width of the structural member 132 in the cross-section of FIG. 9 is the distance from one end 184 of the structural member 132 to another end 186 along the structural member 132), (2) a weight of 6.8 pounds (3.084 kilograms), the weight is an approximation based on the available gage and dimensional variation of the strip from which the beam is made, (3) a cavity height (D1) (the inside dimension between the top flange 146 at the lower portion 154 and the bottom flange 162) of 2.688 inches (6.828 centimeters), (4) a gauge of 0.054 inch (0.1372 centimeter), (5) a top flange width (D2) of 1.278 inches (3.246 centimeters) (as measured from the end 184 to the inwardly facing surface of the web 144 at 174), (6) a bottom flange width (D3) of 1.024 inches (2.601 centimeters) (as measured from the end 186 to the inwardly facing surface of the web 144), (7) a web height (D4) of 2.814 inches (7.148 centimeters), (8) an overall height (D5) of 3.201 inches (8.131 centimeters), (9) a hardness of 12 on the Webster scale,

(10) the base surface (D6) measures 1.550 inches (3.937 centimeters) with each of the opposing sidewalls measuring 0.477 inches (1.212 centimeters),

(11) the spaced apart portion (D7) is 0.727 inch (1.847 centimeters), and

(12) the spaced apart portion (D8) is 0.094 inch (0.2388 centimeter).

A moment of inertia for the beam 130 may be calculated for each section of the beam 130 by determining a centroid of each section and then summing the moments of inertia for each section as described above with respect to the shelf support beam 28.

TABLE 3

| Section | $I_C$ (in$^4$) | $Ad^2$(in$^4$) | $I_x$(in$^4$) |
|---|---|---|---|
| 134 | 0.11 | 0.004 | 0.114 |
| 136 | 0.01 | 0.148 | 0.158 |
| 140 | 0.01 | 0.158 | 0.168 |
| $I_{total}$ | | | 0.440 |

The moment of inertia of the cross-section of the shelf support beam 130 is greater than 0.403. As shown, the moment of inertia is 0.440 or about 9% greater than the moment of inertia of beam 28. As such, the theoretical capacity of the exemplary shelf support beam 130 is believed to be greater than the beam shown in FIG. 2 by at least about 9%.

As described above, the dimensions of the shelf support beam 130 are different than the shelf support beam 28 though the strip widths are the same. Despite being of equivalent strip widths, the different dimensions of the shelf support beam 130 with the recessed region 164 produce a greater moment of inertia than the moment of inertia of the shelf support beam 28.

By way of comparison, the overall height dimension of the shelf support beam 130 is greater than the overall height dimension of the beam 28 by at least 7%. In one embodiment, the overall height D5 of the shelf support beam 130 is about 3.2 inches (about 8.128 centimeters). However, the strip width remains the same at 5.735 inches (14.57 centimeters). For equivalent strip widths, the shelf support beam 130 shown in FIGS. 8-10 has a greater load carrying capacity than the beam 28 of FIGS. 2 and 3.

By way of further comparison, a cavity height D1 of the web 144 (FIG. 9) is greater than the cavity height A1 of the web 40 (FIG. 3). Where the strip width remains the same for each of the shelf support beams 28 and 130, lengthening the web 144 relative to the web 40 to increase the cavity height requires a reduction in the width dimensions of one or both of the flanges 146 and 162. In the exemplary embodiment, and by way of example only, the top flange 146 measures 1.278 inches (3.246 centimeters) as compared to the top flange 42 of the shelf support beam 28, which measures 1.385 inches (3.518 centimeters), and the bottom flange 162 measures 1.024 inches (2.601 centimeters) as compared to the bottom flange 48, which measures 1.253 inches (3.183 centimeters). A ratio of the dimensions of the cavity height relative to the sum of the widths of the top flange and the bottom flange for the shelf support beam 130 shown in FIGS. 8-10 is about 1.20 (see FIG. 9, e.g., dimension D1 of 2.688 inches (6.828 centimeters) to dimension D3 of 1.024 inches (2.601 centimeters) plus dimension D2 of 1.278 inches (3.246 centimeters) (total of 2.297 inches (5.834 centimeters)) is 1.170). According to one embodiment of the invention, the shelf support beam 130 has a ratio of cavity height to the sum of the flange widths of greater than 1. Advantageously, the shelf support beam 130 may be produced from the same material stock as the shelf support beam 28 though the shelf support beam 130 is capable of carrying greater loads.

Figure 11:
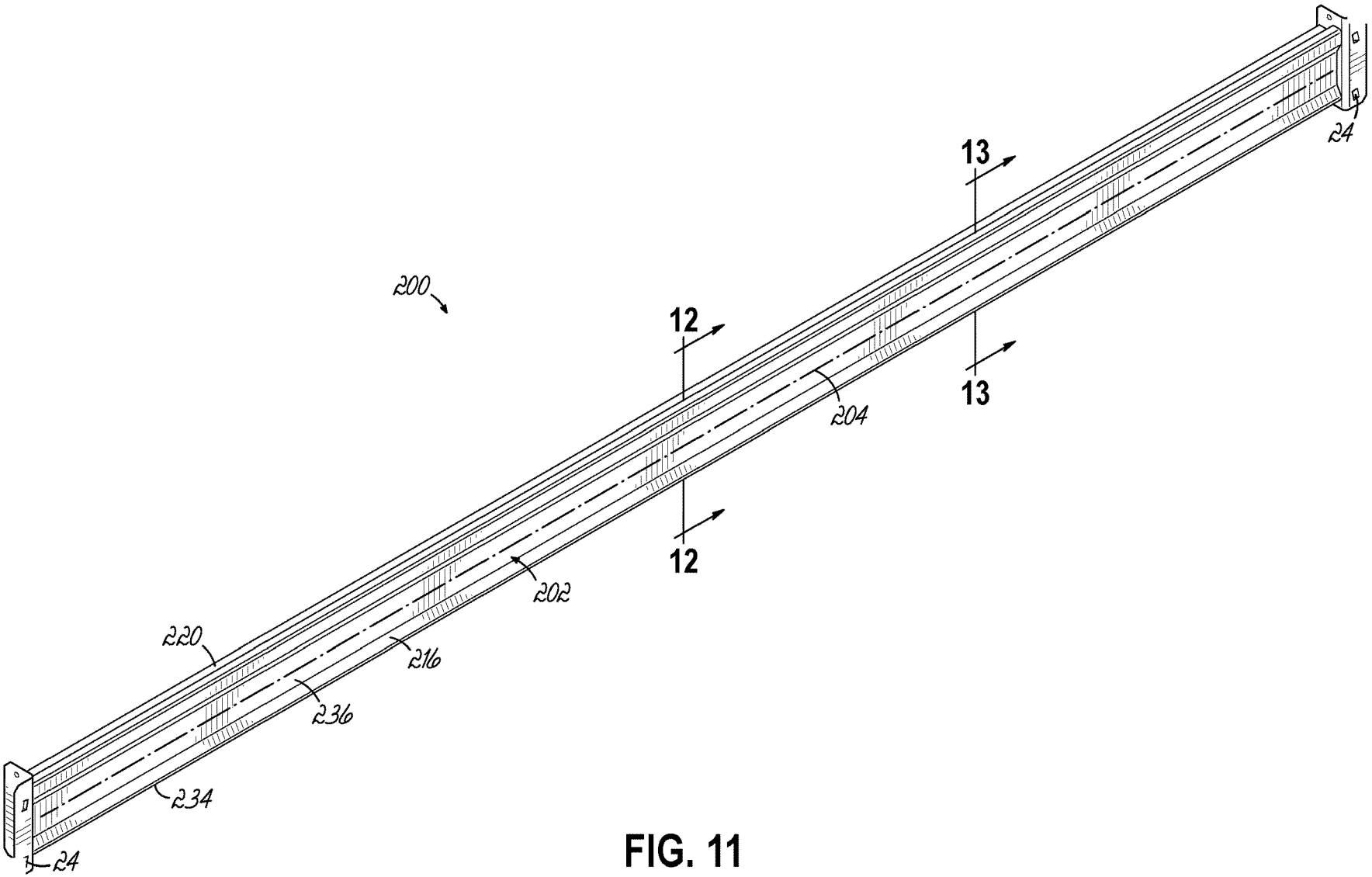
FIG. 11 is a perspective view of a shelf support beam of FIG. 1 according to one embodiment of the invention.
Figure 12:
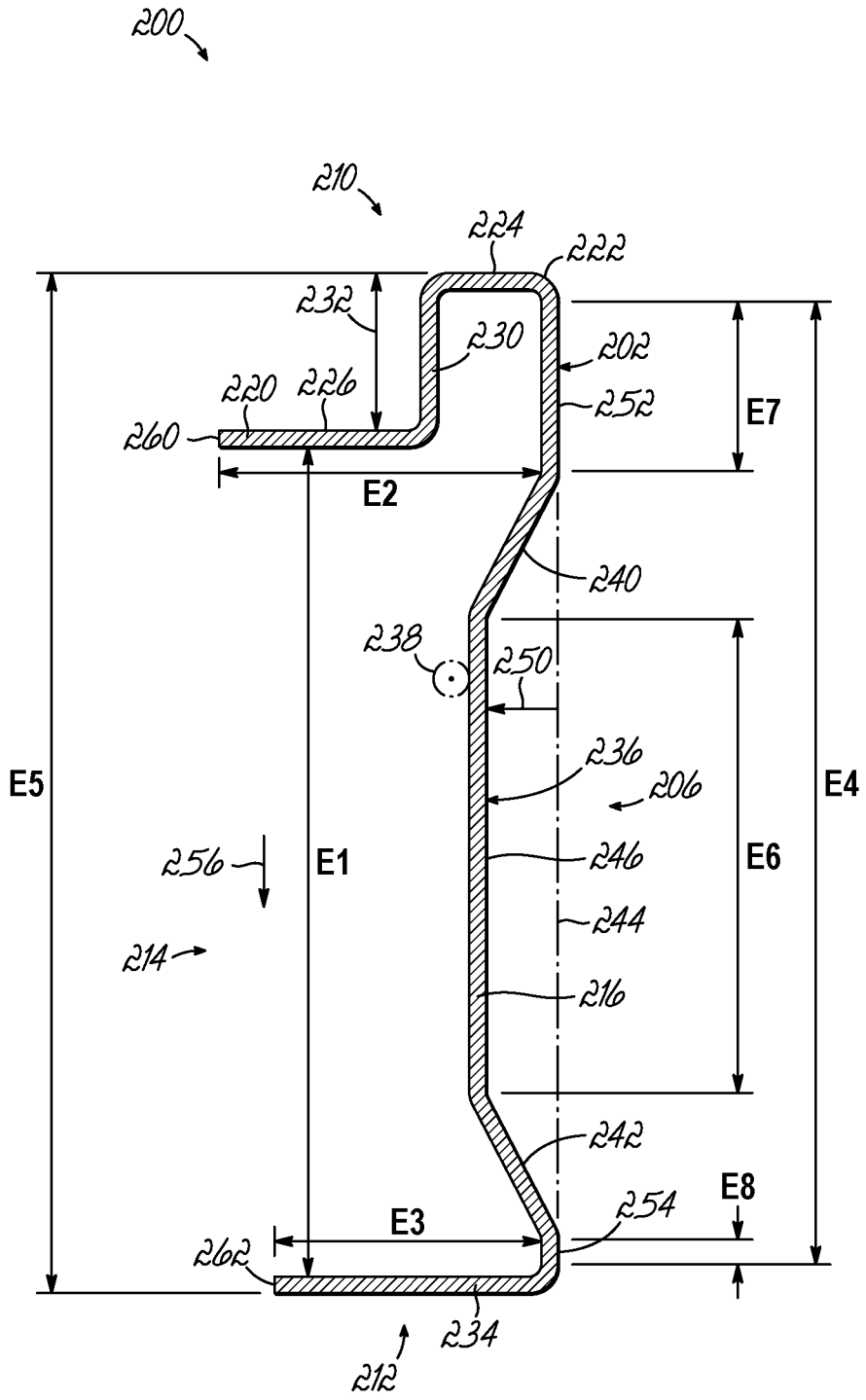
FIG. 12 is a cross-sectional view of a shelf support beam FIG. 11 taken along section line 12-12 of FIG. 11.
Figure 13:
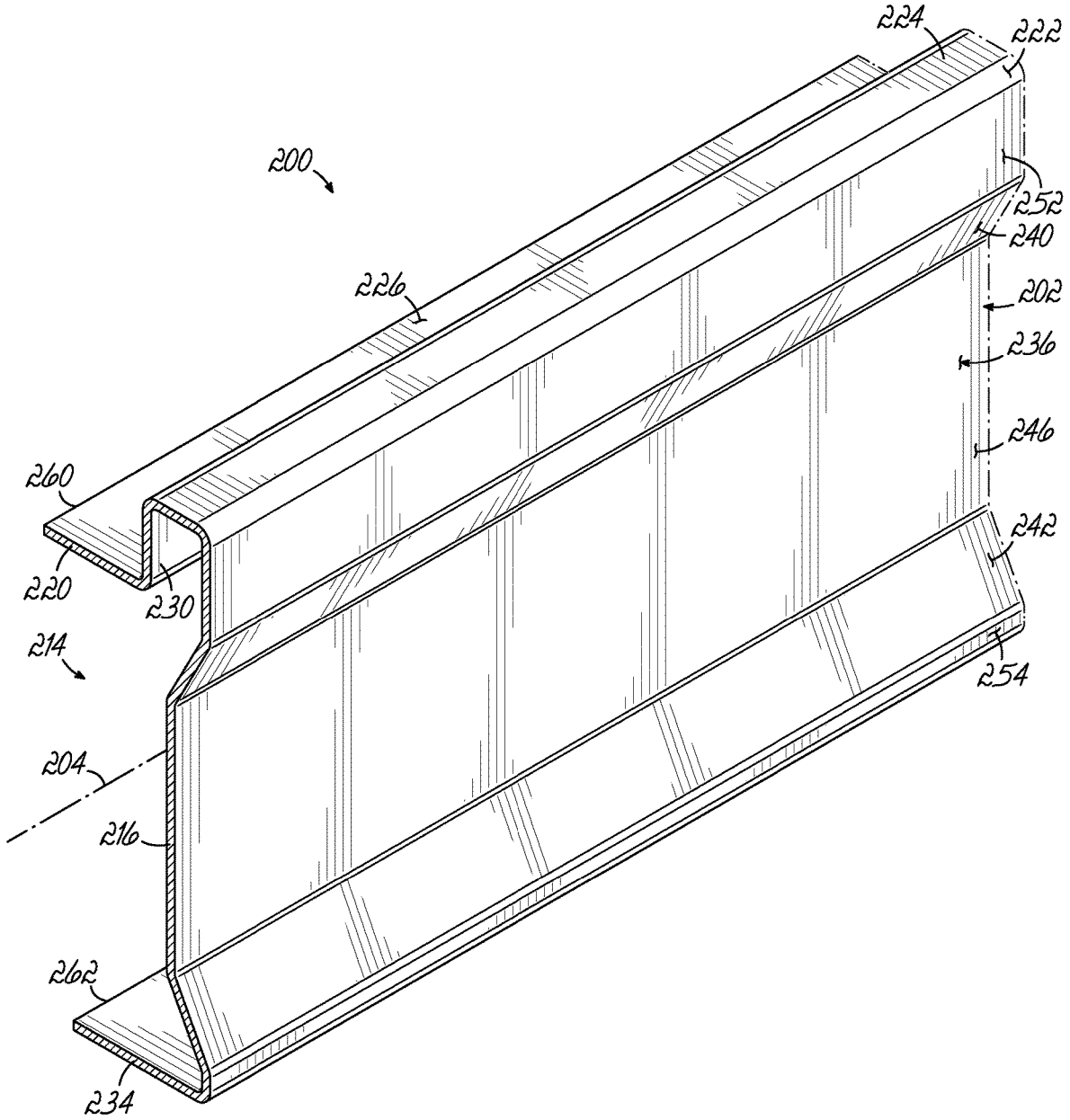
FIG. 13 is an isometric cross-sectional detail view taken along line 13-13 of FIG. 11 showing a portion of one embodiment of the invention.

With reference now to FIGS. 11, 12, and 13, in one embodiment of the invention, a shelf support beam 200 has a greater moment of inertia relative to the beam 28. The shelf support beam 200 is one embodiment of the shelf support beams 14 shown in FIG. 1. Further in that regard, the shelf support beam 200 generally consists of a structural member 202 that is formed in a generally C-shape and having a longitudinal axis 204. The exemplary shelf support beam 200 may be visually sectioned into three parts, i.e., section 206, section 210, and section 212 (best shown in FIG. 12) for a moment of inertia calculation with the procedure set out above with respect to the shelf support beam 28 of FIGS. 2 and 3. The section 206 separates section 210 from section 212 and defines a channel 214. Overall, the arrangement of the sections 206, 210, and 212 defines a C-shaped cross-sectional configuration.

In that C-shaped cross-sectional configuration, section 206 includes a web 216, which forms a vertical portion of the structural member 202 during use. The section 210 defines a top flange 220 and is configured to receive the shelf 22. The top flange 220 extends generally inwardly in the shelving unit 10 (e.g., FIG. 1), and thus in a direction away from the web 216, and has an S-shaped configuration with an elevated portion 222 defining a top surface 224, which unlike the top edge 152 (e.g., shown in FIG. 10) is planar, and a lower portion 226. A sidewall 230 transitions from the elevated portion 222 to the lower portion 226 to provide the S-shaped configuration. The shelf 22 is supported on lower portion 226 with the sidewall 230 providing a stop for lateral movement of the shelf 22 in an outward direction (i.e., toward the web 216) in the shelving unit 10. A pair of opposing shelf support beams 200 on opposing sides of the shelving unit 10 thus captures the shelf 22 between sidewalls 230. Generally, a distance 232 between the top surface 224 and the shelf support 226 may be approximately a thickness of a shelf. The elevated portion 222 may have a rounded or radiused configuration as the structural member 202 transitions from the top surface 224 (which is planar) to the web 216 though that radius is smaller than that shown in FIG. 9.

Section 212 defines a bottom flange 234 that joins the web 216 on an opposite end of the web 216 from the top flange 220. As shown, the web 216 may be radiused at each of the locations at which the structural member 202 transitions to the top flange 220 and to the bottom flange 234. The web 216 is defined in the structural member 202 from a location at which a tangent to the surface curvature of an inner surface of the top flange 220 is parallel to an inner surface of the web 216 at one end to a location at which a tangent to the surface curvature of an inner surface of the bottom flange 234 is parallel to the inner surface of the web 216 at the opposing end. Collectively, the top flange 220, the web 216, and the bottom flange 234 define the structural member 202 and a centroid 238.

With reference to FIGS. 12 and 13, the web 216 includes a recessed region 236 that runs substantially (e.g., 80% or more, 90% or more, and probably greater than 95%) the entire longitudinal length of the shelf support beam 200 as is shown in FIG. 11. Further, the location of the recessed region 236 that has a length less than the entire longitudinal length relative to the longitudinal length may be symmetrically positioned in which a midpoint of the recessed region 236 is aligned with a midpoint of the longitudinal length of the shelf support beam 200. Embodiments of the invention are, however, not limited to a symmetrically positioned recessed region 236. In the exemplary embodiment shown, the recessed region 236 is defined by a pair of outwardly facing sidewalls 240 and 242, which are angled relative to a plane 244 that defines an outer-most surface of the web 216. The opposing sidewalls 240 and 242 intersect a base surface 246.

While the recessed region 236 may decrease an overall height of the shelf support beam 200 (i.e., relative to the shelf support beam 80 shown in FIGS. 5-7 for an equivalent strip width), the recessed region 236 results in an offset 250 of the structural member 202 along a portion of the web 216 in the direction of the channel 214. This offset 250 increases the moment of inertia by a greater degree than any loss in the moment of inertia due to a decrease in overall height dimension of the web 216. While a faceted recessed region 236 (i.e., defined by planar surfaces 240, 242, 246) is shown, the recessed region 236 may have other configurations, such as being rounded, or may have multiple other surfaces that define a portion of the web 216 that is offset from the plane 244 in a direction into the channel 214 and effectively decreasing the depth of the channel 214. In the embodiment shown in FIG. 12, the web 216 and the centroid 238 overlap at the recessed region 236 or the recessed region 236 may be within 0.125 inch (0.3175 centimeter) of the centroid 238.

With reference to FIGS. 12 and 13, the recessed region 236 divides the web 216 into spaced apart outer portions at 252 and 254. The spaced apart outer portions 252 and 254 define the plane 244. In the exemplary embodiment, the base surface 246 is generally parallel to the plane 244 with each of the opposing sidewalls 240 and 242 having approximately the same dimensions and angles. The recessed region 236 may therefore appear to be symmetrical around a centerline of the recessed region 236. Embodiments of the present invention are not limited to a symmetrical recessed region 236. By way of example, the base surface 246 may be at least 40% of the overall height of the cross-section of the shelf support beam 200. By way of further example, the recessed region 236 may be more than 50% of the overall height of the cross-section. With reference to FIG. 12, the recessed region 236 may form about 70% of the overall height of the structural member 202.

Furthermore, the recessed region 236 need not be symmetrically positioned within the web 216. Although embodiments of the invention are not limited to the spacing shown, in FIG. 12, the recessed region 236 is offset relative to the top flange 220 and to the bottom flange 234 as is indicated by arrow 256 with the recessed region 236 being positioned closer to the bottom flange 234. Advantageously, the shelf support beam 200 has a greater moment of inertia than the shelf support beam 28 shown in FIGS. 2 and 3 as is set out below.

Exemplary dimensions of the beam 200 shown in FIGS. 11, 12, and 13 are:

(1) a strip width of 5.735 inches (14.57 centimeters) (the strip width of the structural member 202 in the cross-section of FIG. 12 is the distance from one end 260 of the structural member 202 to another end 262 along the structural member 202), (2) a weight of 7.4 pounds (3.357 kilograms), the weight is an approximation based on the available gage and dimensional variation of the strip from which the beam is made, (3) a cavity height (E1) (the inside dimension between the top flange 220 at the lower portion 226 and the bottom flange 234) of 2.723 inches (6.916 centimeters), (4) a gauge of 0.054 inch (0.1372 centimeter), (5) a top flange width (E2) of 1.056 inches (2.682 centimeters) (as measured from the end 260 to the inwardly facing surface of the web 216 at 252), (6) a bottom flange width (E3) of 0.876 inches (2.225 centimeters) (as measured from the end 262 to the inwardly facing surface of the web 216 at 254), (7) a web height (E4) of 3.159 inches (8.024 centimeters), (8) an overall height (E5) of 3.347 inches (8.501 centimeters), (9) a hardness of 12 on the Webster scale,

(10) the base surface width (E6) is 1.550 inches (3.937 centimeters) with each of the opposing sidewalls being 0.477 inches (1.212 centimeters),

(11) the spaced apart portion (E7) is 0.556 inch (1.412 centimeters), and

(12) the spaced apart portion (E8) is 0.083 inch (0.2108 centimeter).

The moment of inertia for the shelf support beam 200 is calculated for each section of the beam 200 by determining a centroid of each section and then summing the moments of inertia for each section as described above with respect to the shelf support beam 28.

TABLE 4

| Section | $I_C$ (in$^4$) | Ad$^2$(in$^4$) | $I_x$(in$^4$) |
|---|---|---|---|
| 206 | 0.15 | 0.0018 | 0.152 |
| 210 | 0.01 | 0.141 | 0.151 |
| 212 | 0.01 | 0.152 | 0.162 |
| $I_{total}$ | | | 0.465 |

The moment of inertia of the cross-section of the shelf support beam 200 is greater than 0.400 and less than 0.500. By way of comparison with beam 28, the moment of inertia of the beam 200 is about 15% greater than the moment of inertia of the beam 28. The theoretical capacity of the exemplary shelf support beam 200 is determined by finite elemental analysis to be 2,566 pounds (1164 kilograms), which is about a 48% increase in theoretical capacity as compared to the shelf support beam 28 of FIGS. 2-4. Finite elemental analysis was performed on Ansys workbench software with a static structure analysis module, version 19.1. A CAD model of a beam shown in FIGS. 2, 3A, 3B, and 4 with two brackets, one on each end was analyzed. Constraint principles of ANSI MH28.2 standard where adhered to. Testing was completed with an R rating and a four-point flexural testing formula with a maximum deflection of 0.399 inches (1.013 centimeters) under a four-point loading. The deflection limit was calculated using a formula of L/180, where L is a beam span of 71.750 inches (192.405 centimeters).

As described above, the dimensions of the shelf support beam 200 are different than the shelf support beam 28 though the strip widths are the same. Despite being of equivalent strip widths, the different dimensions of the shelf support beam 200 with the recessed region 236 produce a greater moment of inertia than the moment of inertia of the shelf support beam 28. By way of comparison, the moment of inertia of the cross-section of the shelf support beam 28 is 0.403 and the moment of inertia of the cross-section of the shelf support beam 200 is 0.465. Thus, with the same strip width, the moment of inertia increases by 15% by changing the configuration of the cross-section. With regard to the different dimensions, the overall height E5 of the shelf support beam 200 is greater than the overall height A5 of the beam 28 by at least 12%. In one embodiment, the overall height E5 of the shelf support beam 200 is about 3.35 inches (about 8.509 centimeters) (e.g., 3.347). However, the strip width remains the same at 5.735 inches (14.57 centimeters). For equivalent strip widths, the shelf support beam 200 shown in FIGS. 11-13 has a greater load carrying capacity than the beam 28 of FIGS. 2 and 3.

By way of further comparison, the cavity height E1 of the web 216 (FIG. 12) is greater than the cavity height A1 of the web 40 (FIG. 3B). Where the strip width remains the same for each of the shelf support beams 28 and 200, lengthening the web 216 (to increase the cavity height E1) relative to the web 40 requires a reduction in the width dimensions of one or both of the flanges 220 and 234. In the exemplary embodiment, and by way of example only, the top flange 220 measures 1.056 inches (2.682 centimeters) (E2) as compared to the top flange 42 of the shelf support beam 28, which measures 1.385 inches (3.518 centimeters) (A2), and the bottom flange 234 measures 0.876 inch (2.225 centimeters) (E3) as compared to the bottom flange 48, which measures 1.250 inches (3.175 centimeters) (A3). A ratio of the dimensions of the cavity height E1 relative to the sum of the widths of the top flange E2 and the bottom flange E3 for the shelf support beam 200 shown in FIGS. 11-13 is about 1.4 (see FIG. 12, dimension E1 of 2.723 inches (6.916 centimeters) to dimension E3 of 0.876 inch (2.225 centimeters) plus dimension E2 of 1.056 inches (2.682 centimeters) (total of 1.932 inches (4.907 centimeters)) is 1.409, which about 1.4). According to one embodiment of the invention, the shelf support beam 200 has a ratio of cavity height E1 to the sum of the flange widths E2 and E3 of greater than 1. Advantageously, the shelf support beam 200 may be produced from the same material stock as the shelf support beam 28 though the shelf support beam 200 is capable of carrying greater loads.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A shelf support beam for use in a shelving unit to support a shelf comprising:

a structural member having a C-shaped cross-section and including a web separating a top flange that is configured to support the shelf from a bottom flange, the web, the top flange, and the bottom flange define a channel, wherein the channel, the top flange, and the bottom flange define a cavity height, a top flange width, and a bottom flange width, respectively, wherein a ratio of the cavity height to a sum of the top flange width and the bottom flange width is greater than 1, wherein the web includes a recessed region in which the structural member is offset in a direction into the channel, the recessed region being at least 50% of an overall height of the structural member, wherein the top flange includes an elevated portion and a shelf support portion separated by a sidewall and having a S-shaped configuration with the shelf support portion being configured to support the shelf and the sidewall being configured to prevent lateral motion of the shelf toward the web, and wherein the cavity height is defined between the shelf support portion and the bottom flange.

2. The shelf support beam of claim 1 wherein the C-shaped cross-section has a moment of inertia of greater than 0.40.

3. The shelf support beam of claim 1 wherein the C-shaped cross-section has a moment of inertia of greater than 0.45.

4. The shelf support beam of claim 1 wherein the C-shaped cross-section has a moment of inertia of at least 0.46.

5. The shelf support beam of claim 1 wherein the ratio is at least 1.20.

6. The shelf support beam of claim 1 wherein the ratio is about 1.40.

7. The shelf support beam of claim 1 wherein the cavity height is greater than 2.50 inches (6.35 centimeters) and is less than 5.375 inches (13.65 centimeters).

8. The shelf support beam of claim 1 wherein the C-shaped cross-section has a centroid and the centroid is within 0.25 inch (0.635 centimeter) of the web.

9. The shelf support beam of claim 1 wherein the recessed region is in a range of 50% to 70% of an overall height of the structural member.

10. The shelf support beam of claim 1 wherein the recessed region is at least 70% of an overall height of the structural member.

11. The shelf support beam of claim 1 wherein the C-shaped cross-section has a centroid and the centroid is within 0.125 inch (0.3175 centimeter) of the recessed region.

12. The shelf support beam of claim 1 wherein the C-shaped cross-section has a gauge of 0.054 inch (0.1372 centimeter).

13. The shelf support beam of claim 1 wherein the C-shaped cross-section has a strip width of 5.735 inches (14.57 centimeters).

14. The shelf support beam of claim 13 wherein the C-shaped cross-section has a gauge of 0.054 inch (0.1372 centimeter).

15. A shelving unit comprising:

a plurality of posts;

a plurality of shelf support beams of claim 1 configured to be attached to two posts of the plurality of posts; and the shelf configured to be supported on the shelf support beam after the shelf support beam is coupled to the two posts.

16. A method of manufacturing the shelf support beam of claim 1.

17. A shelf support beam for use in a shelving unit to support a shelf comprising:

a structural member having a C-shaped cross-section and including a web separating a top flange that is configured to support the shelf from a bottom flange, the web, the top flange, and the bottom flange define a channel, wherein the C-shaped cross-section has a moment of inertia greater than 0.40, wherein the web includes a recessed region in which the structural member is offset in a direction into the channel, the recessed region being at least 50% of an overall height of the structural member, and wherein the top flange includes an elevated portion and a shelf support portion separated by a sidewall and having a S-shaped configuration with the shelf support portion being configured to support the shelf and the sidewall being configured to prevent lateral motion of the shelf toward the web.

18. The shelf support beam of claim 17 wherein the C-shaped cross-section has an overall height of greater than 2.977 inches (7.562 centimeters).

19. The shelf support beam of claim 17 wherein the moment of inertia of greater than 0.45.

20. The shelf support beam of claim 17 wherein the moment of inertia of at least 0.46.

21. The shelf support beam of claim 17 wherein the C-shaped cross-section has a strip width of 5.735 inches (14.57 centimeters).

22. The shelf support beam of claim 17 wherein the C-shaped cross-section has a gauge of 0.054 inch (0.1372 centimeter).

23. The shelf support beam of claim 17 wherein the channel, the top flange, and the bottom flange define a cavity height, a top flange width, and a bottom flange width, respectively, and wherein a ratio of the cavity height to a sum of the top flange width and the bottom flange width is greater than 1.

24. The shelf support beam of claim 23 wherein the ratio is at least 1.20.

25. The shelf support beam of claim 23 wherein the ratio is about 1.40.

26. A shelving unit comprising:

a plurality of posts;

a plurality of shelf support beams of claim 17 configured to be attached to two posts of the plurality of posts; and the shelf configured to be supported on the shelf support beam after the shelf support beam is coupled to the two posts.

27. A method of manufacturing the shelf support beam of claim 1.

28. The shelf support beam of claim 1 wherein the top flange width is greater than the bottom flange width.

29. The shelf support beam of claim 17 wherein the top flange and the bottom flange define a top flange width and a bottom flange width, respectively, and the top flange width is greater than the bottom flange width.

* * * * *